US012398565B2

(12) United States Patent
Gori et al.

(10) Patent No.: US 12,398,565 B2
(45) Date of Patent: Aug. 26, 2025

(54) SCREENS FOR USE WITH GUTTER GUARD SYSTEMS

(71) Applicant: LeafFilter North, LLC, Hudson, OH (US)

(72) Inventors: Michael Gori, Norton, OH (US); Jason A. Crowell, Akron, OH (US)

(73) Assignee: LeafFilter North, LLC, Hudson, OH (US)

( * ) Notice: Subject to any disclaimer, the term of this patent is extended or adjusted under 35 U.S.C. 154(b) by 0 days.

(21) Appl. No.: 17/933,349

(22) Filed: Sep. 19, 2022

(65) Prior Publication Data

US 2025/0146286 A1 May 8, 2025

(51) Int. Cl.
*E04D 13/00* (2006.01)
*E04D 13/076* (2006.01)

(52) U.S. Cl.
CPC ..... *E04D 13/076* (2013.01)

(58) Field of Classification Search
CPC ..... E04D 13/076
See application file for complete search history.

(56) References Cited

U.S. PATENT DOCUMENTS 4,745,710 A * 5/1988 Davis ..... E04D 13/076 210/473
5,010,696 A * 4/1991 Knittel ..... E04D 13/076 52/12
5,406,754 A * 4/1995 Cosby ..... E04D 13/076 52/12
7,975,435 B2 * 7/2011 Lenney ..... E04D 13/076 52/12
8,495,837 B2 * 7/2013 McCoy ..... E04D 13/076 52/12
8,756,868 B2 * 6/2014 McCoy ..... E04D 13/076 52/12
10,125,496 B2 * 11/2018 Lenney ..... E04D 13/064
10,465,388 B2 * 11/2019 Brochu ..... H02K 21/026
10,655,334 B2 * 5/2020 Gori ..... E04D 13/076
11,591,801 B2 * 2/2023 Ealer, Sr. ..... E04D 13/076
2010/0287846 A1 * 11/2010 Lenney ..... E04D 13/0762 52/12
2011/0067318 A1 * 3/2011 Lenney ..... E04D 13/076 52/12

(Continued)

*Primary Examiner* — Basil S Katcheves
(74) *Attorney, Agent, or Firm* — Benesch Friedlander Coplan & Aronoff LLP

(57) ABSTRACT

Disclosed herein are gutter guard systems arranged to efficiently manage the flow of rainwater across the system and prevent the matting of debris onto the system. In one exemplary embodiment, a gutter guard system includes a main body and a screen covering the main body. The gutter guard assembly further includes a front receiver and a rear receiver that secure the screen to the main body. The screen includes at least one feature arranged to manage the flowrate of rainwater across the gutter guard system. In one example, the feature is a raised rounded area that slows the flowrate of rainwater across the gutter guard system. In another embodiment, the screen includes an upwardly angled section and a transition section. Once assembled and installed, the transition section and optionally the angled section forms hurdles that slows the flowrate of rainwater across the gutter guard system.

26 Claims, 38 Drawing Sheets

(56) References Cited

U.S. PATENT DOCUMENTS

| | | | | |
|---|---|---|---|---|
| 2012/0042579 | A1* | 2/2012 | McCoy | E04D 13/076 52/12 |
| 2014/0215929 | A1* | 8/2014 | Lenney | E04D 13/064 52/12 |
| 2016/0060870 | A1* | 3/2016 | Martin | E04D 13/064 52/12 |
| 2016/0102459 | A1* | 4/2016 | Breyer | E04D 13/0767 52/12 |
| 2017/0009456 | A1* | 1/2017 | Lenney | E04D 13/0725 |
| 2018/0274239 | A1* | 9/2018 | Cullen | E04D 13/076 |
| 2020/0308839 | A1* | 10/2020 | Neeb | E04D 13/068 |
| 2020/0354959 | A1* | 11/2020 | Hicks | E04D 15/003 |
| 2022/0042315 | A1* | 2/2022 | Neeb | E04D 13/068 |
| 2022/0275648 | A1* | 9/2022 | Lenney | E04D 13/076 |

* cited by examiner

SCREENS FOR USE WITH GUTTER GUARD SYSTEMS

FIELD OF INVENTION

The present disclosure generally relates to systems and methods for preventing debris from entering rain gutters while managing the flow of rainwater into the rain gutter. More specifically, the present disclosure relates to novel screens for use with gutter guard systems, where the screens are designed and arranged to moderate the flowrate of rainwater across a gutter guard systems to optimizing the infusion or rainwater into the rain gutter.

BACKGROUND

Rain gutter systems are commonly used for residential homes, buildings, and other structures to manage rainwater by collecting the rainwater and channeling that rainwater away from the structure. Such management of rainwater can be critical for the overall maintenance and condition of the structure by reducing or eliminating damage to the structure and its foundation that can be caused by uncontrolled rainwater. Gutter guard systems are components or systems that are typically attached to or incorporated into rain gutters to prevent leaves, pine needles, branches, soot, and other such debris from entering the rain gutter. Without the protection of gutter guards, such debris can enter and clog the rain gutter and reduce its effectiveness in channeling rainwater away from a residential home, building, or other structure. In addition, such debris can damage and shorten the service life of a rain gutter system by causing corrosion, pitting, or other deleterious effects on the rain gutter system.

Gutter guard systems are most effective when rainwater flowing from the roof and passing over the gutter guard system is effectively managed to facilitate the rainwater passing downward through the gutter guard system and into the rain gutter. Unfortunately, not all prior art gutter guard systems effectively manage rainwater flowing across the gutter guard system, particularly when the volume and flowrate of the rainwater is high. A high volume and flowrate of rainwater can be caused by heavy rains, but also can be caused by certain features of roofs, such as valleys and dormers, which result in channeling and concentrating rainwater from large surface areas of the roof to smaller areas of the rain gutters positioned at the roofline. In such circumstances, rainwater can pass over the entire surface of the gutter guard system without flowing downward into the rain gutter, which often results in rainwater falling to the ground at the base of the home or structure. Furthermore, when prior art gutter guard systems are inefficient and/or ineffective in managing the flow of rainwater across the gutter guard system, another common occurrence is the collection and matting of debris over time onto the upward-facing surface of gutter guard systems. As will be understood, such issues can result in insufficient protection from damage cause by rainwater and result in reductions in property value, increases in maintenance costs, and dangerous conditions for occupants of structures.

A common component of a gutter guard system is a mesh screen. Such a screen covers the rain gutter and stops debris from entering the rain gutter while allowing rainwater to pass through the screen into the rain gutter. However, certain prior art screens do little to manage the flowrate of water across the screen. As noted above, the flowrate at which rainwater moves across prior art screens is typically proportional to the rate of rainfall at any given time, which can be further enhanced by roof features such as valleys and dormers. The greater the volume of rainfall, the higher the flowrate of rainwater across the screen. Thus, when the volume of rainfall is high, the flowrate of water across the screen is often too fast for a satisfactory amount of rainwater to pass through the screen and into the rain gutter. This results in rainwater passing over the gutter guard system and pouring onto the ground at the base of the structure where it can cause short-term and long-term damage. One method of managing the flow of rainwater from the roof to the gutter guard system is to install splashguards at the roofline to divert and slow the flow of rainwater prior to the rainwater reaching the gutter guard system. However, one drawback of splashguards is that it is common for debris to become trapped behind the splashguard, which reduces the effectiveness of splashguards and necessitates the periodic cleaning of splashguards.

There is a need for novel arrangement and methods for using gutter guard systems, particularly mesh screens used with gutter guard systems that provides more efficient and effective management and channeling of rainwater and resistance of matting of debris on the gutter guard system. Specifically, there is a need for improved mesh screens for use with gutter guard systems that manage the flowrate of rainwater as it passes over the mesh screen so that the channeling of rainwater into the rain gutter is not affected by the rate at which rain is falling or particular features of the roof. In such an arrangement, the need for splashguards can be reduced or eliminated. This disclosure provides such improved mesh screens and gutter guard systems.

SUMMARY

Disclosed herein are gutter guard systems arranged to efficiently manage the flow of rainwater across the system and prevent the matting of debris onto the gutter guard system. In one exemplary embodiment, a gutter guard system includes a main body and a screen covering the main body. The main body includes a front receiver, a rear receiver, and a water management section positioned between the front receiver and rear receivers. In one example, the main body, front receiver, and rear receiver are formed as one integral component. In an alternative example, the front receiver and rear receiver are separate components that are arranged to be assembled with the main body. The screen is positioned to span the main body and is secured to the main body by engagement on one end with the front receiver and on the opposite end with the rear receivers.

The screen is arranged to manage the flow of rainwater across the screen and downward through the screen into the rain gutter. The screen can include certain features that affect the flowrate and path of rainwater as the rainwater flows across the screen. In one embodiment, the screen includes a raised section running along the length of the screen. The raised section can be generally rounded and semi-circular in cross-section. The raised section provides a barrier to the flow or rainwater that slows the rainwater as it flows across the raised area of the screen. The reduction in flowrate provides a greater opportunity for the rainwater to pass through the screen and into the rain gutter. Such features can limit or eliminate the need for splashguards that are often installed along a structure's roofline to divert and slow the flow of rainwater prior to the rainwater reaching the gutter guard system. When splashguards are eliminated so is the need for periodic cleaning of debris behind such splashguards.

In another embodiment, a screen includes a first section positioned proximate to the rear receiver, a second section positioned proximate to the front receiver, and a transition section between the first and second sections. Once the screen is assembled with the gutter guard system and the gutter guard system is installed onto a rain gutter, the transition section is arranged at an upward slope, which forms a hurdle that rainwater must overcome as it flows across the screen. Such a hurdle causes the rainwater flowrate across the screen to slow and provides additional time for the rainwater to pass through the screen toward the water management section. Additionally, once assembled and installed, the second section of the screen can be positioned at an upward angle, which further slows the flowrate of rainwater across the screen and results in a greater amount of rainwater flowing through the screen and into the rain gutter. Another benefit of this design is that it increases the surface area of the screen, which creates additional opportunity for water to pass through the screen and into the rain gutter.

In an embodiment of a screen assembly for use with a gutter guard system, the screen assembly includes a mesh screen with a first section, a second section, and a waterflow obstacle section positioned between the first section and second section and a grid with a first section that conforms in shape to the first section of the mesh screen, a second section that conforms in shape to the second section of the mesh screen, and a waterflow obstacle section positioned between the first section and second section that conforms in shape to the waterflow obstacle section of the mesh screen. The mesh screen and grid are secured together to form the screen assembly so that the first section of the mesh screen and first section of the grid are positioned adjacent to each other and form a first section of the screen assembly, the second section of the mesh screen and second section of the grid are positioned adjacent to each other and form a second section of the screen assembly, and the waterflow obstacle section of the mesh screen and waterflow obstacle section of the grid are positioned adjacent to each other and form a waterflow obstacle section of the screen assembly. When the screen assembly is positioned in a gutter guard system, the waterflow obstacle section of the screen assembly slows the flow of water across the screen assembly. In this embodiment, the waterflow obstacle section can be generally semicircular in shape and rises above the remainder of the screen assembly, or the waterflow obstacle section can be a rectangular, generally flat section joining the first section of the screen assembly and the second section of the screen assembly and extending along the longitudinal length of the screen assembly.

To facilitate installation of the screen assembly into a gutter guard system, the mesh screen further includes a first transition section, a first tab, a second transition section, and a second tab, and the grid further includes a first transition section that conforms in shape to the first transition section of the mesh screen, a first tab that conforms in shape to the first tab of the mesh screen, a second transition section that conforms in shape to the second transition section of the mesh screen, and a second tab that conforms in shape to the waterflow obstacle section of the mesh screen. When the mesh screen and grid are secured together the first transition section of the mesh screen and first transition section of the grid are positioned adjacent to each other and form a first transition section of the screen assembly, the first tab of the mesh screen and the first tab of the grid are positioned adjacent to each other and form a first tab of the screen assembly, the second transition section of the mesh screen and second transition section of the grid are positioned adjacent to each other and form a second transition section of the screen assembly, and the second tab of the mesh screen and the second tab of the grid are positioned adjacent to each other and form a second tab of the screen assembly. The first and second tabs of the screen assembly are useful in engaging with a front and rear receiver of a gutter guard system to secure the screen assembly to the gutter guard system.

BRIEF DESCRIPTION OF THE DRAWINGS

In the accompanying drawings, structures are illustrated that, together with the detailed description provided below, describe example embodiments of the disclosed systems, methods, and apparatus. Where appropriate, like elements are identified with the same or similar reference numerals. Elements shown as a single component can be replaced with multiple components. Elements shown as multiple components can be replaced with a single component. The drawings may not be to scale. The proportion of certain elements may be exaggerated for the purpose of illustration.

DETAILED DESCRIPTION

Figure 1:
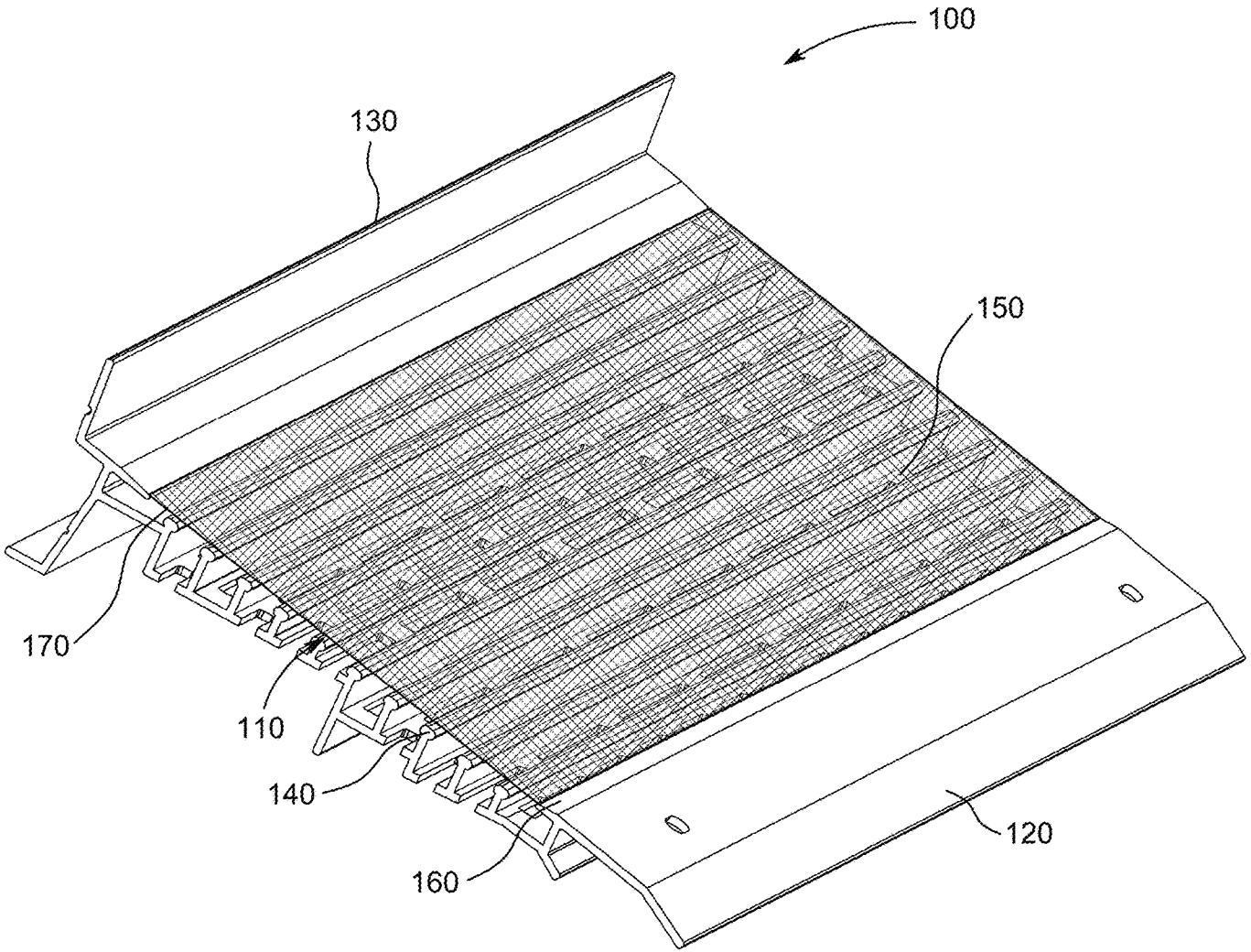
FIG. 1 schematically illustrates a perspective view of a first embodiment of a gutter guard system.

The apparatus, systems, arrangements, and methods disclosed in this document are described in detail by way of examples and with reference to the figures. It will be appreciated that modifications to disclosed and described examples, arrangements, configurations, components, elements, apparatus, methods, materials, etc. can be made and may be desired for a specific application. In this disclosure, any identification of specific techniques, arrangements, method, etc. are either related to a specific example presented or are merely a general description of such a technique, arrangement, method, etc. Identifications of specific details or examples are not intended to be and should not be construed as mandatory or limiting unless specifically designated as such. Selected examples of gutter guard systems and screens for use with such gutter guard systems are hereinafter disclosed and described in detail with reference made to FIGS. 1-38.

As will be described in detail herein, an exemplary embodiment of a novel gutter guard system includes a main body and a screen. In one embodiment the main body includes an integrated front receiver and rear receiver. In another embodiment, the front receiver and rear receiver can be individual components that are arranged to be secured to the main body. The gutter guard system is arranged to be positioned proximate to the top opening of a rain gutter installed on a home or other structure. Typically the gutter guard system generally spans the top opening of the rain gutter. As will be described herein, the screen assists in managing the flow of rainwater across the gutter guard system to provide for efficient and effective flow of rainwater across the screen and down through the screen and into the rain gutter. The screen is arranged to control the flowrate of rainwater across the screen and discourage the matting of debris on the top side of the screen through the screen's construction, positioning, and design features. The main body is arranged to promote airflow in and around the main body and screen in both in the vertical and horizontal directions. Such flow of air in multiple directions effectively discourages debris from resting on and subsequently matting on the top side of the screen. Additionally, for any debris that does rest on the top side of the screen, the air flow dries the debris, which further discourages matting of the debris to the top side of the screen.

The gutter guard system can be manufactured in a plurality of sizes to accommodate various sizes of rain gutters. For example, as will be described and illustrated herein, the gutter guard system can be manufactured to accommodate a three inch rain gutter, a four-inch rain gutter, five-inch rain gutter, or a six-inch rain gutter. The gutter guard system can be manufactured to accommodate various styles of rain gutters. In particular, the structure of the front receiver and rear receiver relative to the main body can be arranged to accommodate a number of different style of rain gutters, such as K-style, half-round, fascia style, and even custom designed rain gutters. The examples described and illustrated herein may be directed to specific styles and sizes of rain gutters; however, it will be understood that such examples are non-limiting. The gutter guard systems described herein can be arranged to accommodate any style and size of rain gutter. Coatings and/or films of various colors can be applied to the front receivers and/or rear receivers to enhance the aesthetic appeal and weather resistance of the front and rear receivers.

The main body and front and rear receivers can be manufactured from a number of materials, including metal and polymeric material such as polyvinyl chloride (PVC), polyethylene (PE), polyolefin (PO), or any other relatively rigid polymer. The main body and front and rear receivers can be manufactured using a variety of methods including extrusion, injection molding, additive manufacturing (i.e., 3D printing), machining, metal casting, metal stamping, punching, and the like. In some embodiments, more than one manufacturing process can be used. For example, a main body can be machined, stamped, punched, or otherwise modified, after it is formed via extrusion or injection molding. In one embodiment, the main body is manufactured from a polymeric material using an extrusion process. Slots in the channels of the water management section are formed by a punching process. The punching process can be performed in-line with the extrusion process or can be an off-line process that punches the holes after the extrusion process is complete. The examples of gutter guard systems described and illustrated herein are not limiting or exhaustive, and one of ordinary skill in the art will readily understand that components of the gutter guard system can be manufactured in any number of ways.

In one embodiment, the screen is a 30 mesh metal screen. In one example, the screen can be made of 316L stainless steel wire, more specifically, 316L stainless steel wire that is 0.0085 inches in diameter. The screen can be arranged in a square weave such that there are 30 wires for each linear inch of screen in both the width and length directions. In such an arrangement, the surface area of the screen includes approximately 55% open area. It will be understood with such a large percentage of open area, the screen can facilitate water flowing through the screen toward and into the rain gutter even when debris such as leaves temporarily come to rest on top of the screen. The 0.0085 inch diameter 316L stainless steel wire arranged as such provides a number of benefits, including resistance to corrosion and rust when exposed to the elements, generally prevents common debris from passing through the screen, inhibits self-cleaning of the screen due to debris passing over the screen, and promotes water infusion through the screen as water travels across the screen. Furthermore, in one embodiment, such an arrangement maintains a generally flat surface when exposed to the elements so that the screen maintains its functionality and aesthetic appeal over time. In other embodiments, as will be described herein, the screen includes features and contours that rise above the general plane to the screen to manage flowrates of rainwater and promote rainwater infusion through the screen and to prevent or limit the matting of debris on the top of the screen.

FIG. 1 schematically illustrate a first embodiment of a gutter guard system 100. The gutter guard system 100 includes a main body 110 with a front receiver 120, a rear receiver 130, and a water management section 140 positioned between and connecting the front receiver 120 and rear receiver 130. The front receiver 120, the rear receiver 130, and the water management section 140 are integrally formed into a continuous main body 110. The gutter guard system 100 further includes a screen 150 spanning the water management section 140 and secured to the main body 110 by an interior extending edge 160 of the front receiver 120 and an interior extending edge 170 of the rear receiver 130. The screen 150 illustrated in FIG. 1 is a flat screen that is generally in contact with features of the water management section 140.

Figure 2:
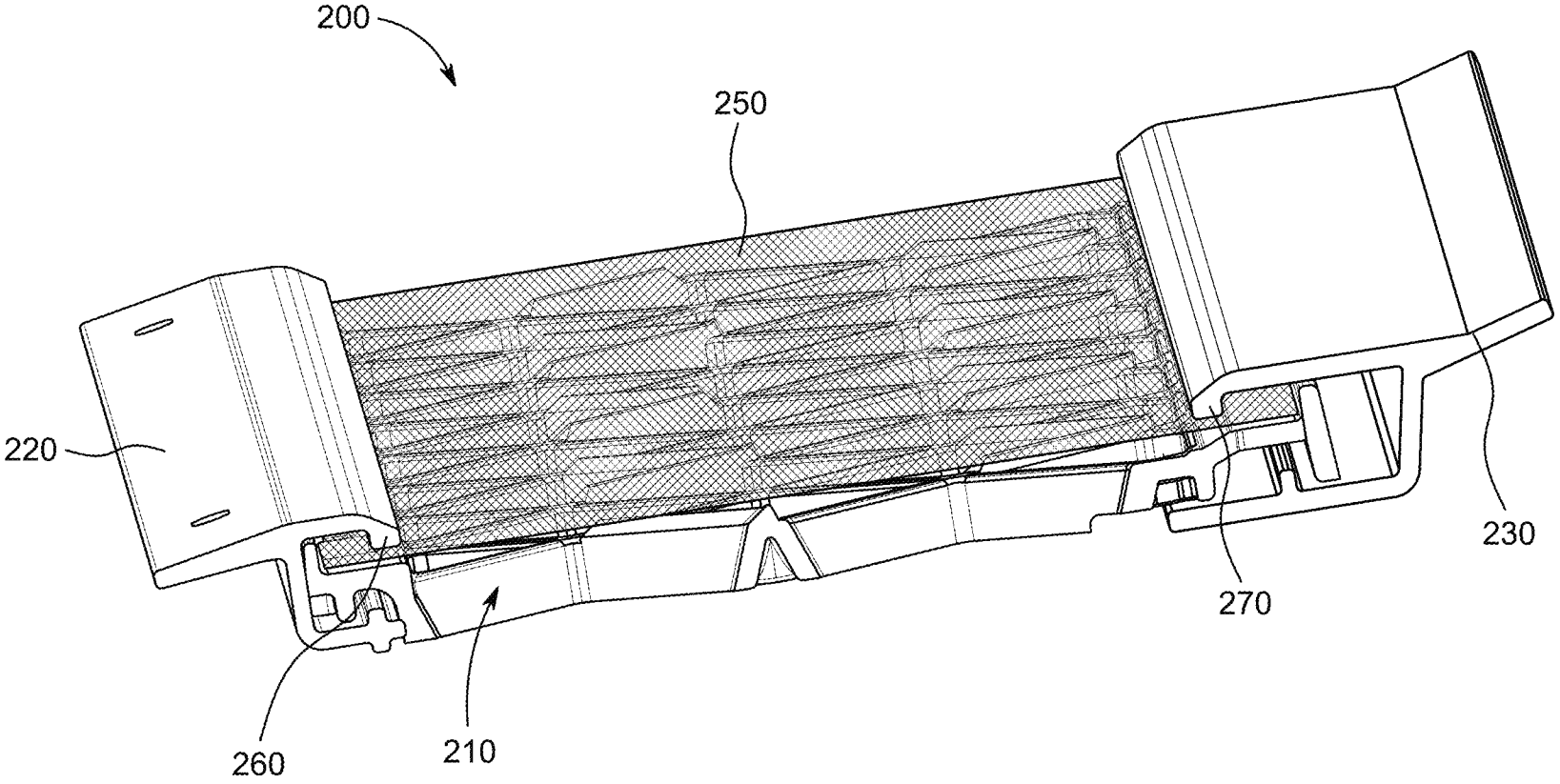
FIG. 2 schematically illustrates a perspective view of a second embodiment of a gutter guard system.

FIG. 2 schematically illustrate a second embodiment of a gutter guard system 200. The gutter guard system 200 includes a main body 210 with a front receiver 220 and a rear receiver 230. The front receiver 220 and the rear receiver 230 are individual components that are arranged to be secured to the main body 210 when the gutter guard system 200 is assembled. The gutter guard system 200 further includes a screen 250 spanning the main body 210 and secured to the main body 210 by an interior extending edge 260 of the front receiver 220 and by an interior extending edge 270 of the rear receiver 230. The screen 250 illustrated in FIG. 2 is a flat screen that is generally in contact with features of the main body.

In either embodiment shown in FIGS. 1-2. when a screen 150, 250 is assembled with a main body 110, 210, one edge of the screen 150, 250 is positioned under an inward extending edge 160, 260 of the front receiver 120, 220 and the opposite edge of the screen 150, 250 is positioned under an inward extending edge 170, 270 of the rear receiver 130, 230. In such an arrangement, the edges of the screen 150, 250 are slightly deformed by their engagement with the front receiver 120, 220 and rear receiver 130, 230. Such slight deformation creates a friction fit that secures the screen 150, 250 in place relative to the main body 110, 210. Additionally, an adhesive or other similar substance can be used to secure the screen 150, 250 to the main body 110, 210.

In addition to the screens 150, 250 illustrated in FIGS. 1-2, alternative designs for screens can be used with the gutter guard systems disclosed herein. Such alternative designs include features that manage the flow of rainwater across the screen and provide for improved airflow and self-cleaning of the screen. For example, such alterative screens can include features that moderate the flowrate at which rainwater passes along the surface of the screen by slowing the flowrate at which rainwater passes along the surface of the screen. It will be appreciated that as the flowrate of rainwater passing along the surface slows, more rainwater can pass through the screen and into the rain gutter. In another example, such alternative screens can include features that promote the free flow of air through the screen. Such airflow can dry any debris resting on the surface of the screen to discourage matting of the debris and can further result in the airflow removing the debris (i.e., blowing away the debris) from the surface of the screen. Such mechanisms for gutter guard systems are referred to herein as "self-cleaning" mechanisms.

Figure 3:
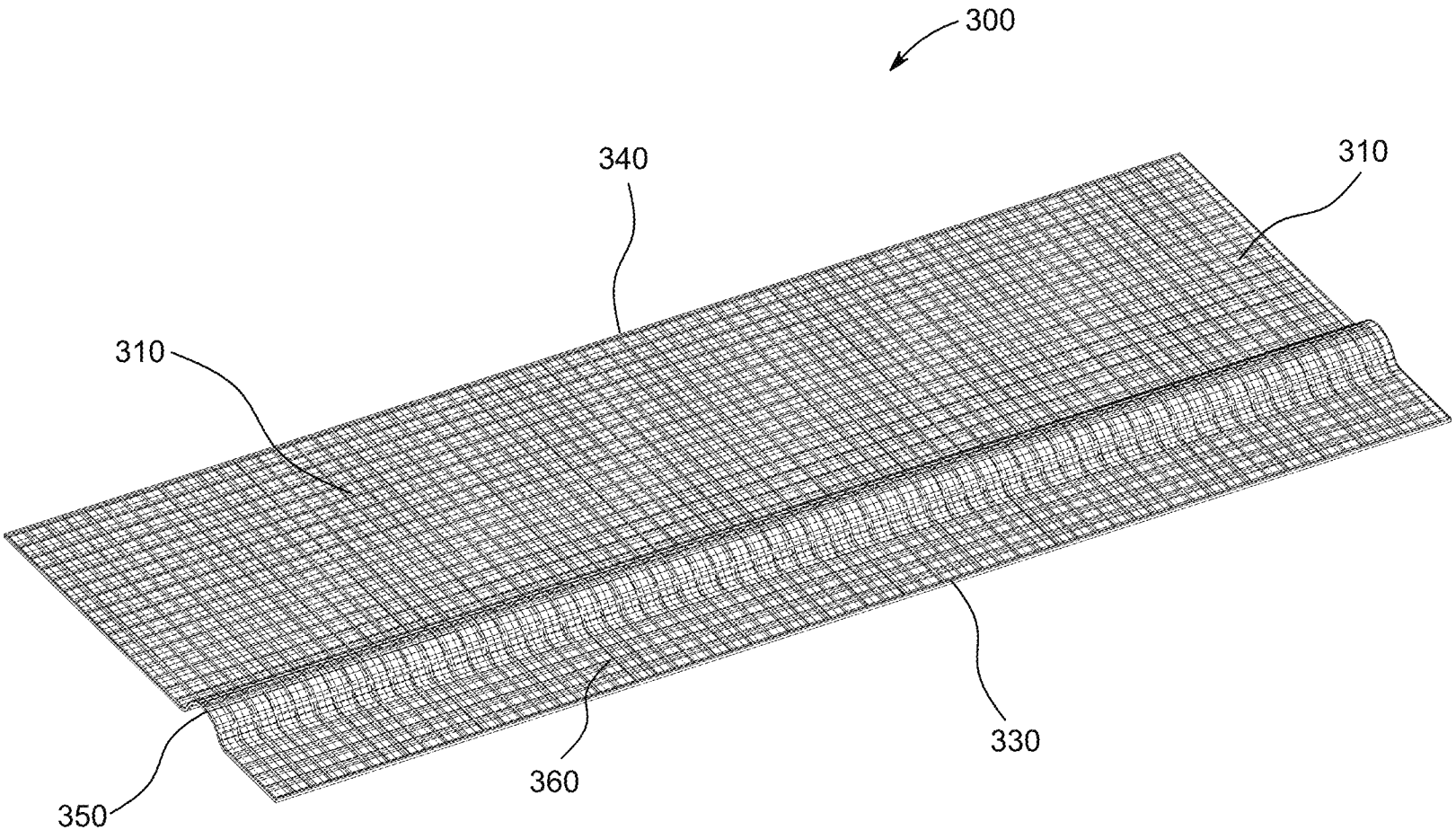
FIG. 3 schematically illustrates a perspective view of a first embodiment of a screen assembly for use with a gutter guard system.
Figure 4:
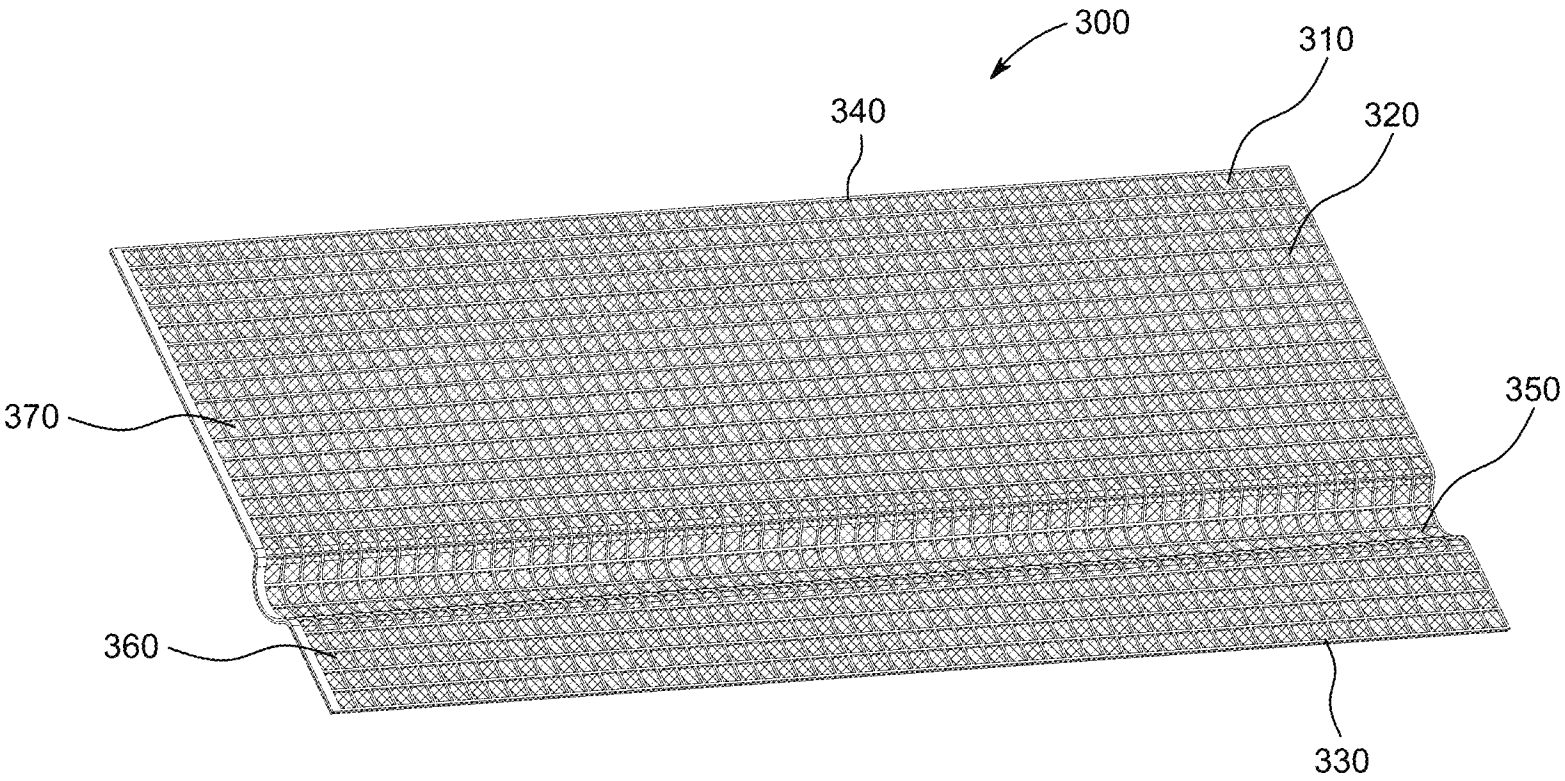
FIG. 4 schematically illustrates another perspective view of the screen assembly of FIG. 3.
Figure 5:
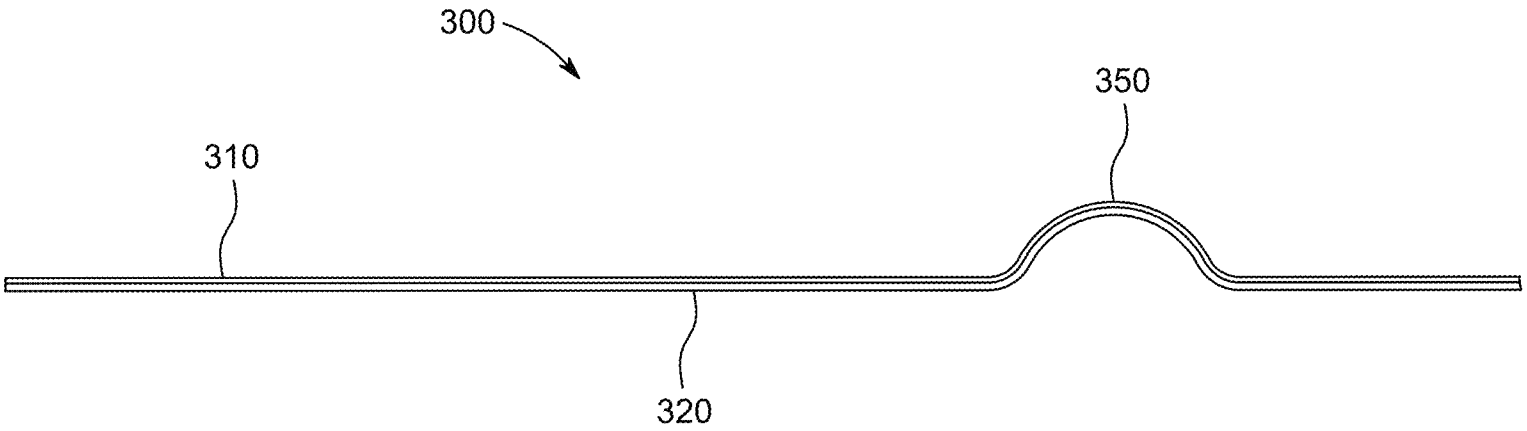
FIG. 5 schematically illustrates side view of the screen assembly of FIG. 3.
Figure 6:
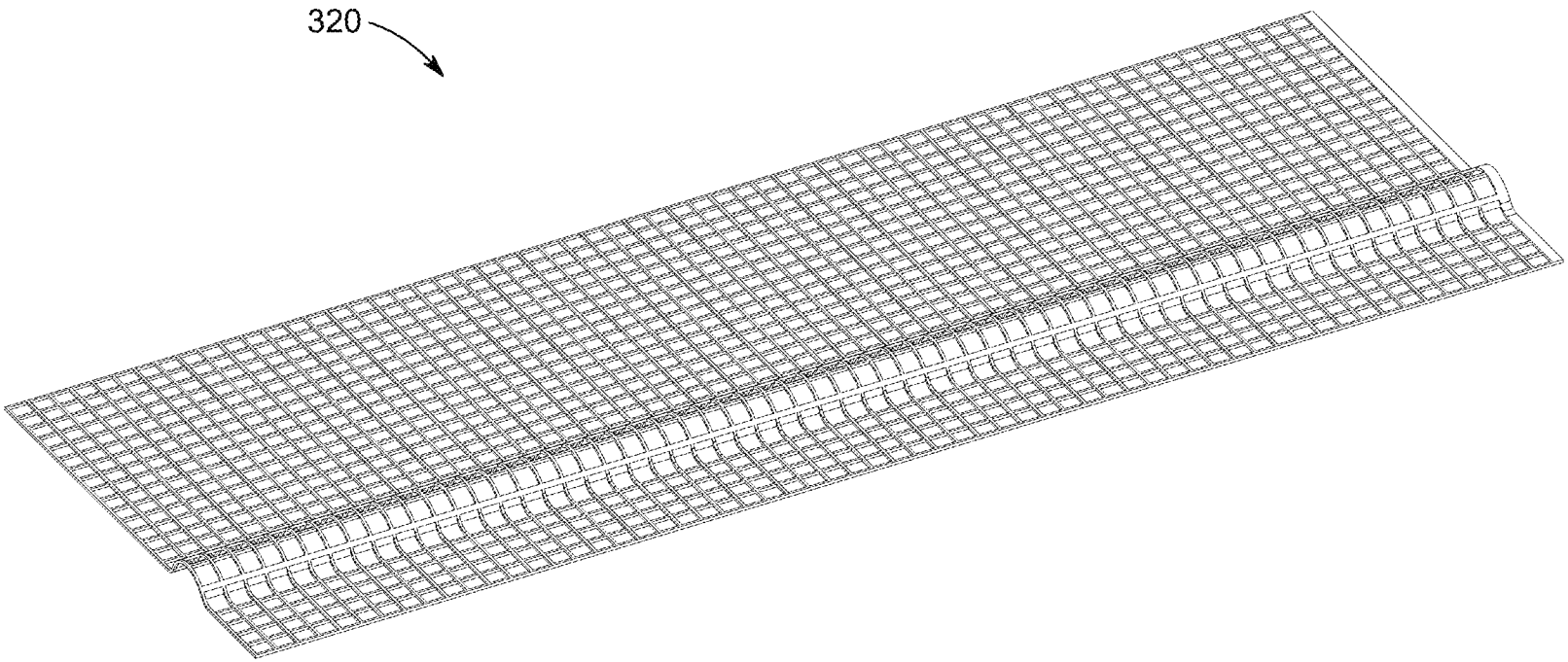
FIG. 6 schematically illustrates a perspective view of a component of the screen assembly of FIG. 3.

One example of such an alternative screen is illustrated in FIGS. 3-6. This alternative screen is a screen assembly 300 comprising a mesh screen 310 and a grid 320. The mesh screen 310 is a 30 mesh metal screen made of 316L stainless steel wire that is 0.0085 inches in diameter. The mesh screen 310 can be arranged in a square weave such that there are 30 wires for each linear inch of mesh screen 310 in both the width and length directions of the of the mesh screen 310. The grid 320 is a metal grid made of 316L stainless steel wire that is 0.0220 inches in diameter. The grid 320 can be arranged in a matrix structure such that there are 4 wires for each linear inch of the grid 320 in both the width and length directions of the of the grid 320. The mesh screen 310 and grid 320 are secured together into the screen assembly 300 using any number of applicable techniques and methods including spot welding or a mechanical connection. One such mechanical connection includes arranging the mesh screen 310 so that a portion of the mesh screen 310 extends past the edge(s) of the grid 320. These excess portions of the mesh screen are then folding under the grid 320 along one or more edges of the grid 320. The mesh screen 320 is then crimping along these edges to secure the mesh screen 310 to the grid 320. The mesh screen 310, with its small openings, is arranged to allow rainwater to pass through the mesh screen 310 but prevent debris from passing through the mesh screen 310. The grid 320 is fabricated so that it is generally rigid in structure and maintains its shape when assembled with the mesh screen 310. Thus, the grid 320 provides structural support for the assembly 300 so that mesh screen 310 does not sag or deform when assembled with a gutter guard system and deployed in the field. FIG. 3 is a topside perspective view of the screen assembly 300, FIG. 4 is a bottom side perspective view of the screen assembly 300 (where the mesh screen 310 can be seen through the openings of the grid 320), FIG. 5 is a side view of the screen assembly 300, and FIG. 6 is a perspective view of only the grid 320. As will be further discussed, the screen assembly 300 can be used with the modular gutter guard assembly 200 illustrated in FIG. 2.

The screen assembly 300 includes a front edge 330 and rear edge 340 with a raised section 350 positioned between the front edge 330 and rear edge 340 running along the length of the screen assembly 300 and generally parallel to the front 330 and rear 340 edges. Extending between the front edge 330 and the raised section 350 is a relatively short front section 360 and extending between the rear edge 340 and the raised section 350 is a longer flat rear section 370. In one example, the front 360 and rear 370 sections are generally rectangular, flat sections that extend along the longitudinal length of the screen assembly 300. As illustrated in the figures, the raised and rounded section 350 is positioned closer to the front edge 330 than the rear edge 340. The raised section is generally rounded and semi-circular in cross-section. The embodiment of the screen assembly 300 illustrated in FIGS. 3-6 is designed to accommodate a gutter guard system for a five inch rain gutter. In this embodiment, the overall width of the screen assembly 300 is approximately 3.8125 inches, with the front section 360 approximately one inch in width, the rear section approximately three inches in width, and the raised section 350 is approximately 0.75 inches in width and approximately 0.75 inches in height. It will be understood that dimensions provide herein are mere examples of one arrangement of a screen assembly. The raised section can include different geometric arrangements and shapes than illustrated herein, and dimensions can be adjusted to accommodate varying widths of gutters and different climate conditions.

When assembled with a gutter guard system, the front edge 330 of the screen assembly 300 is arranged to be positioned within the front receiver, and the rear edge 340 is arranged to be positioned with the rear receiver. Once assembled with a gutter guard system, the mesh screen 310 is arranged to face upward so that it is directly exposed to the flow of rainwater across the gutter guard assembly, and the grid 320 is arranged to face downward and adjacent to the main body of the gutter guard assembly.

As illustrated and described herein, the raised section 350 serves as a hurdle or obstacle to the flow and flowrate of rainwater passing along the surface of the screen assembly 300. Such a waterflow obstacle or hurdle slows the flowrate of rainwater as it passes over the screen assembly 300. Such slowing of the flowrate of rainwater across the surface of the screen assembly 300 results in the rainwater remaining on the surface of the screen assembly 300 for a longer period of time; thus, providing more opportunity for the rainwater to flow downward, pass through the screen assembly 300 and into the rain gutter. As noted above, if a gutter guard system is designed for an area that experiences heavy rains or for a roof with many features that concentrate the flow of rainwater from the roof to a small section of the rain gutter, the dimensions and placement of the raised section 350 can be adjusted to accommodate anticipated high volumes and flowrates of rainwater. As an additional benefit, the raised and rounded section 350 of the screen assembly 300 promotes the free flow of air across and through the surface of the screen assembly 300. Such free flow of air dries any debris resting on the surface of the screen assembly 300 and blows away such debris from the screen assembly 300. Thus, the screen assembly 300 as illustrated facilitates the self-cleaning of the gutter guard system.

Figure 7:
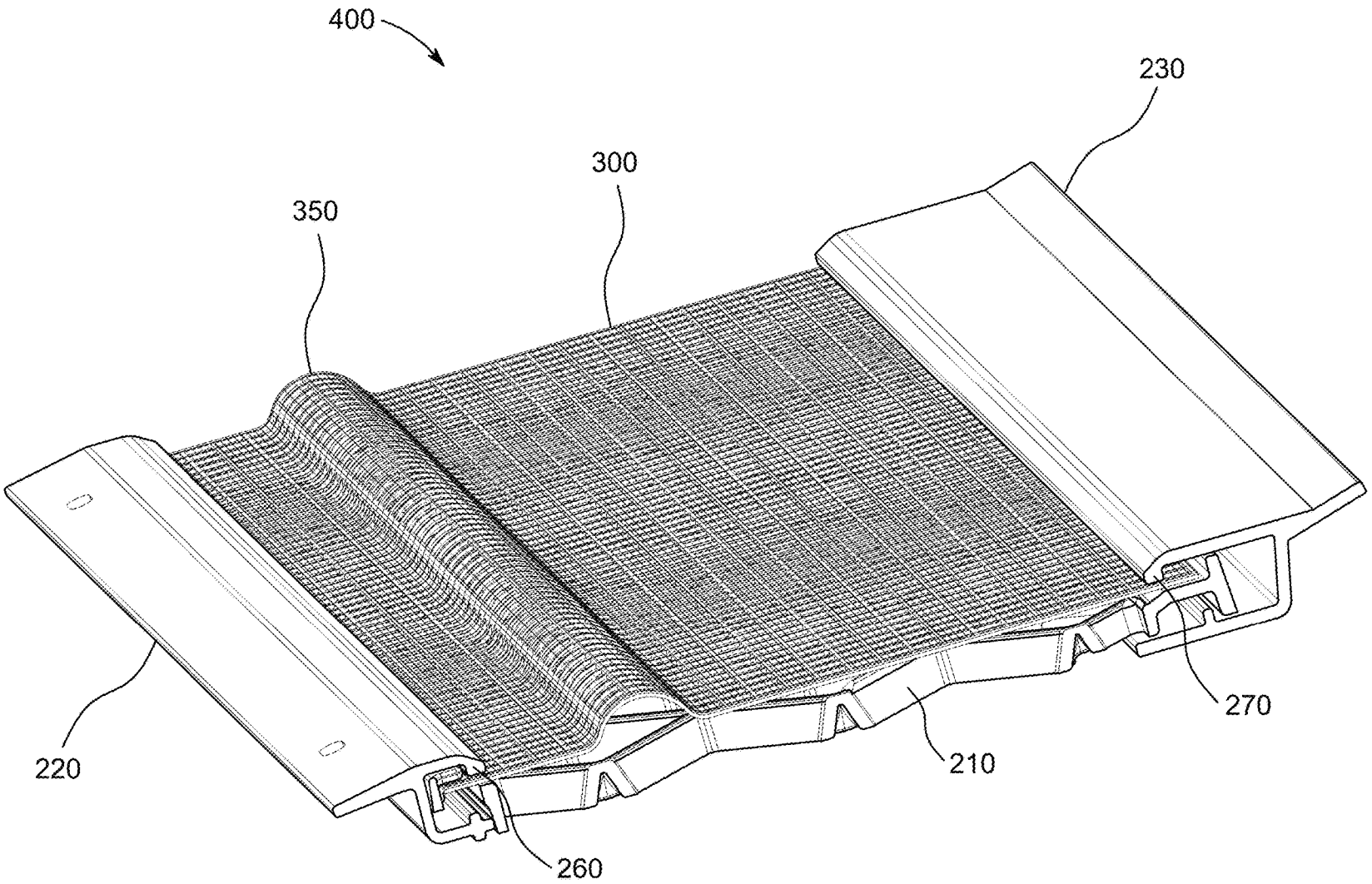
FIG. 7 schematically illustrates a perspective view of the gutter guard system of FIG. 2 with the screen assembly of FIG. 3.
Figure 8:
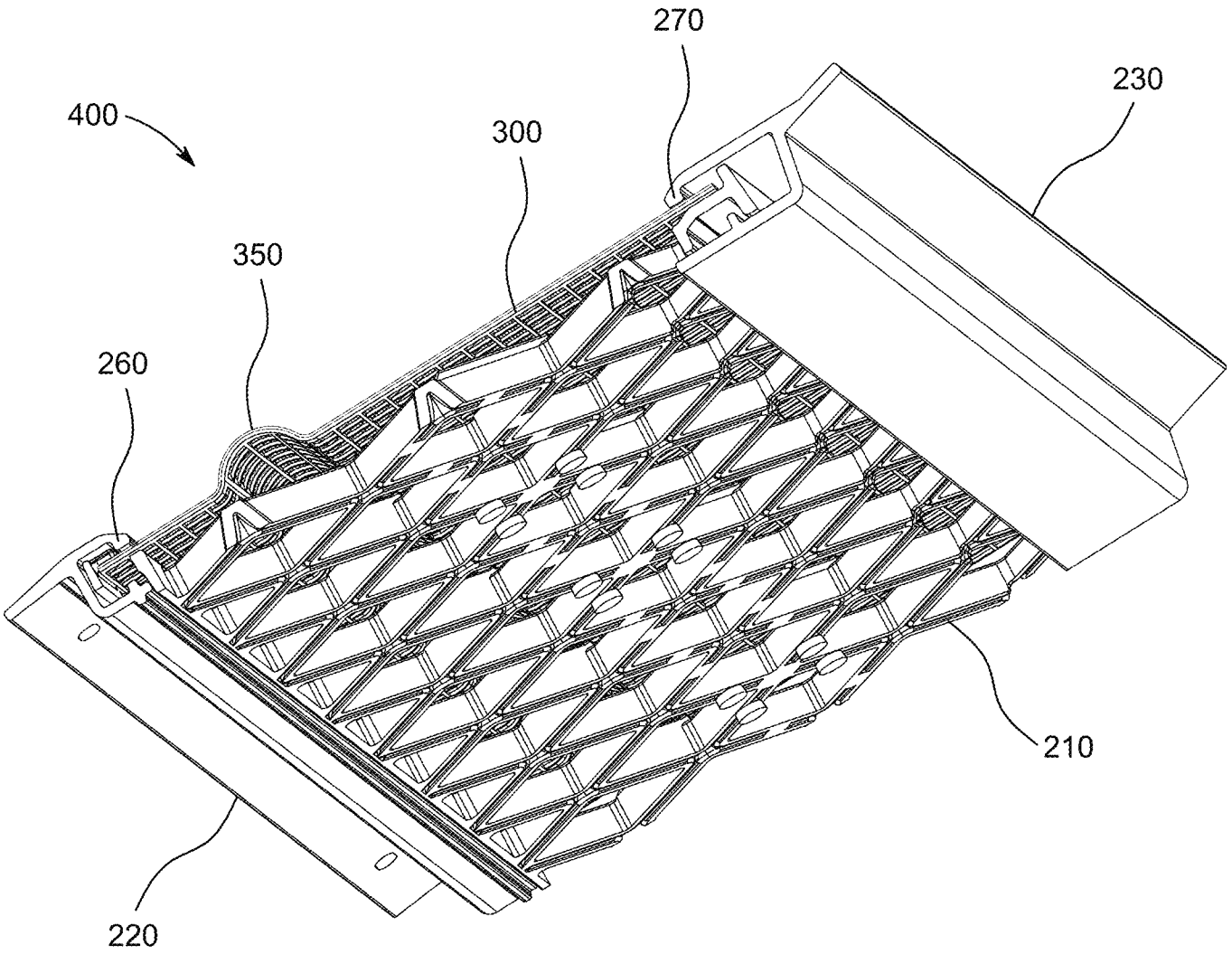
FIG. 8 schematically illustrates another perspective view of the gutter guard system of FIG. 2 with the screen assembly of FIG. 3.
Figure 9:
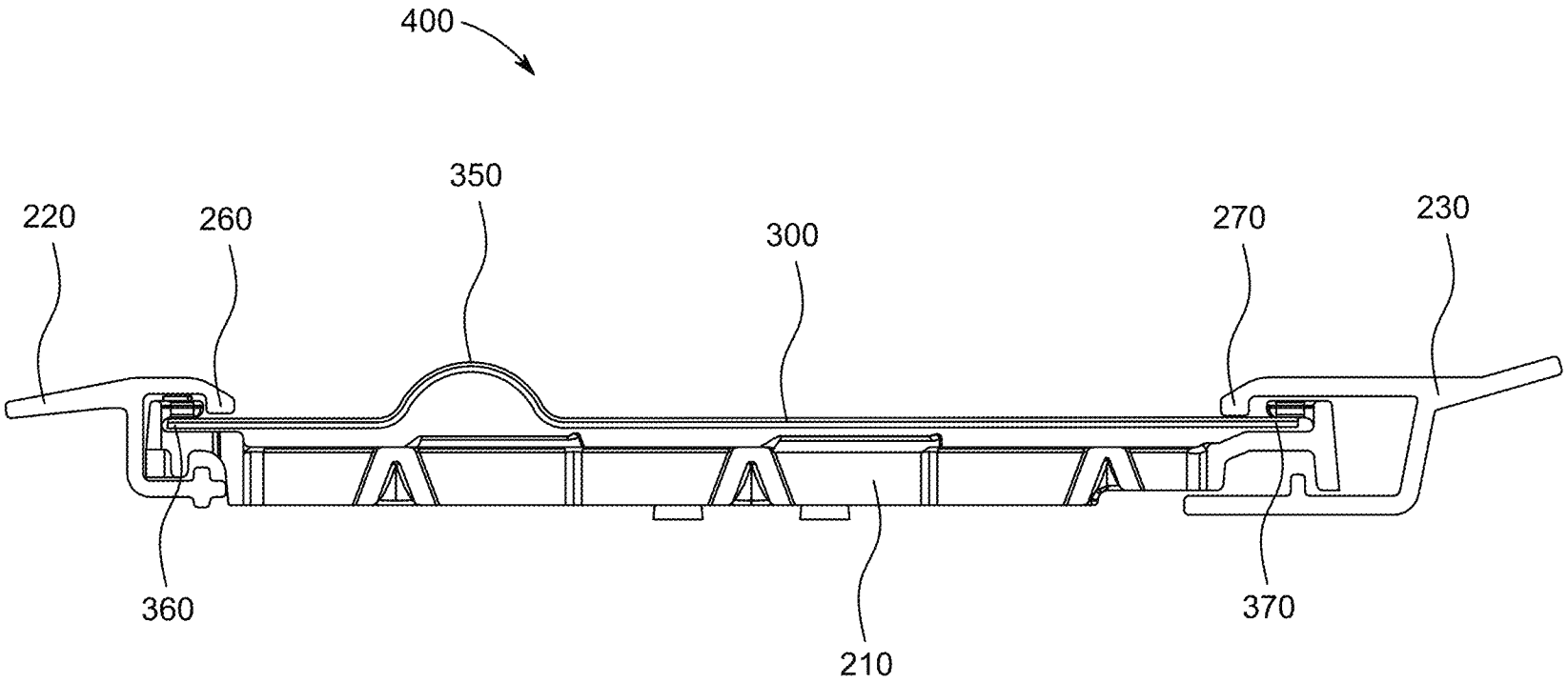
FIG. 9 schematically illustrates a side view of the gutter guard system of FIG. 2 with the screen assembly of FIG. 3.

FIGS. 7-9 illustrate two perspective views and a sided view of a novel gutter guard system 400 wherein the screen assembly 300 of FIGS. 3-6 is assembled with a front receiver 220, rear receiver 230, and main body 210 of the gutter guard system illustrated in FIG. 2. As best illustrated in the side view, the front edge 330 of the screen assembly 300 is tucked under the interior extending edge 260 of the front receiver 220, and the rear edge 340 of the screen assembly 300 is tucked under the interior extending edge 270 of the rear receiver 230. The front 330 and rear 340 edges of the screen assembly 300 may be slightly deformed by their engagement with the front receiver 220 and rear receiver 230. Such slight deformation creates a friction fit that secures the screen assembly 300 in place relative to the main body 210. Additionally, an adhesive or other similar substance can be used to secure the screen assembly 300 to the main body 210. The raised and rounded section 350 extends longitudinally along the width of the screen assembly 300 and is generally positioned between the front receiver 220 and rear receiver 230 once assembled with the gutter guard system 400. Once the assembled gutter guard system 400 is installed onto a rain gutter, the rear receiver 230 is positioned on the rear portion of the rain gutter and the front receiver 220 is positioned on the front portion of the rain gutter. This typically results in the screen assembly 300 positioned at a downward angle from the rear of the rain gutter to the front of the rain gutter. Such a downward angle accelerates the flowrate of rainwater across the screen assembly 300. The location and arrangement of the raised and rounded section 350 slows the flowrate of rainwater across the screen assembly 300, which provides more time and opportunity for rainwater to pass downward through the screen and into the rain gutter. It will be understood that in certain installations where high volumes of rain are anticipated, the raised section 350 can be increased in size and in width to accommodate the anticipated higher volumes and flowrates of rainwater.

The components for the gutter guard assembly 400 illustrated in FIGS. 7-9 can be fabricated and assembled in varying lengths such as, for example, five foot lengths. These five foot gutter guard assemblies 400 can be installed adjacent to one another in straight sections of rain gutters. It is typical that the last gutter guard assembly 400 installed along a straight length of rain gutter may have to be trimmed to match the actual length of the straight section of rain gutter. The components of the gutter guard system 400 are fabricated such that it is relatively easy to cut and trim a gutter guard assembly to a specific size using common tools such as saws, cutters, exacto-knives, and the like.

Figure 10:
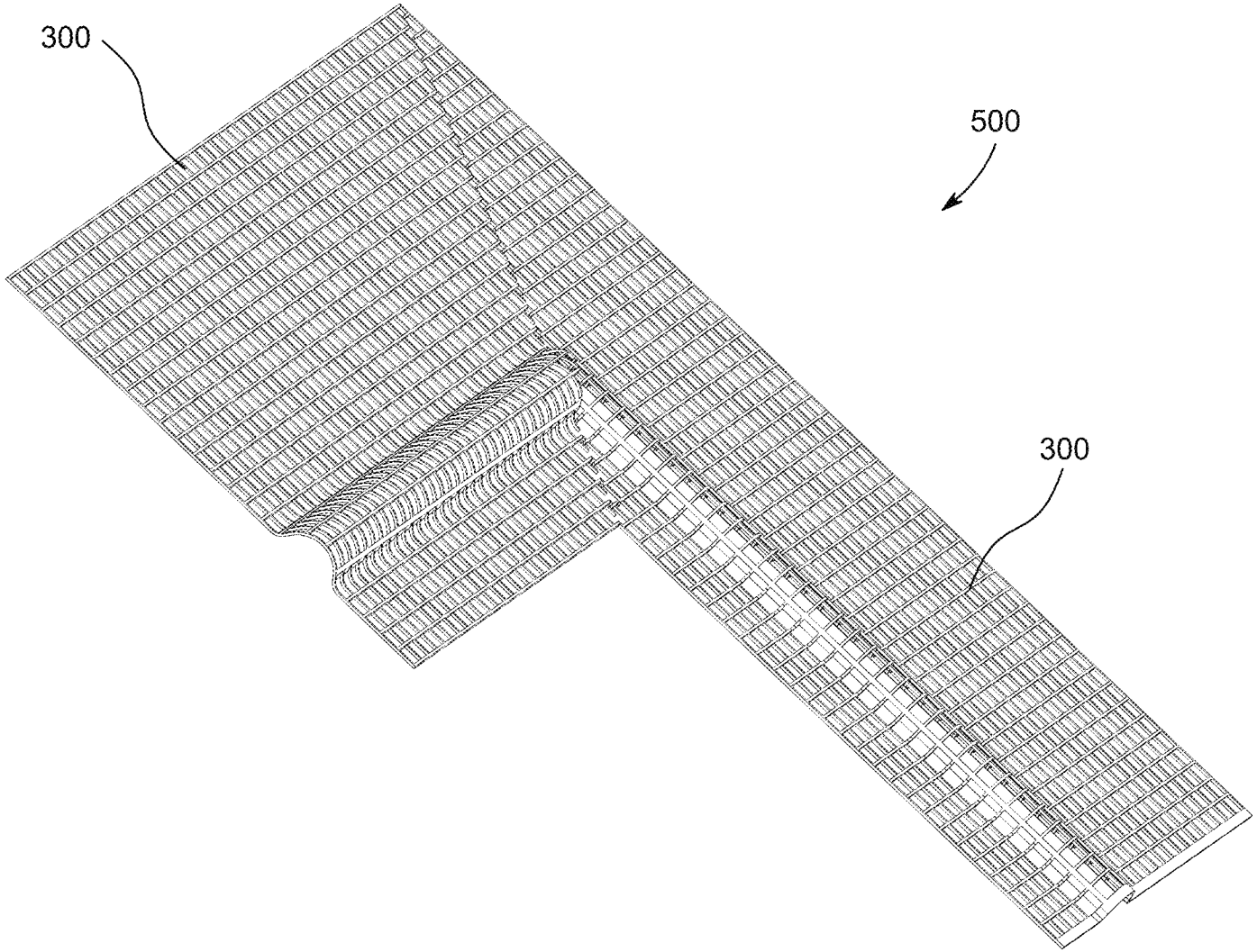
FIG. 10 schematically illustrates a perspective view of an inside corner screen assembly fabricated from screen assemblies of FIG. 3.
Figure 11:
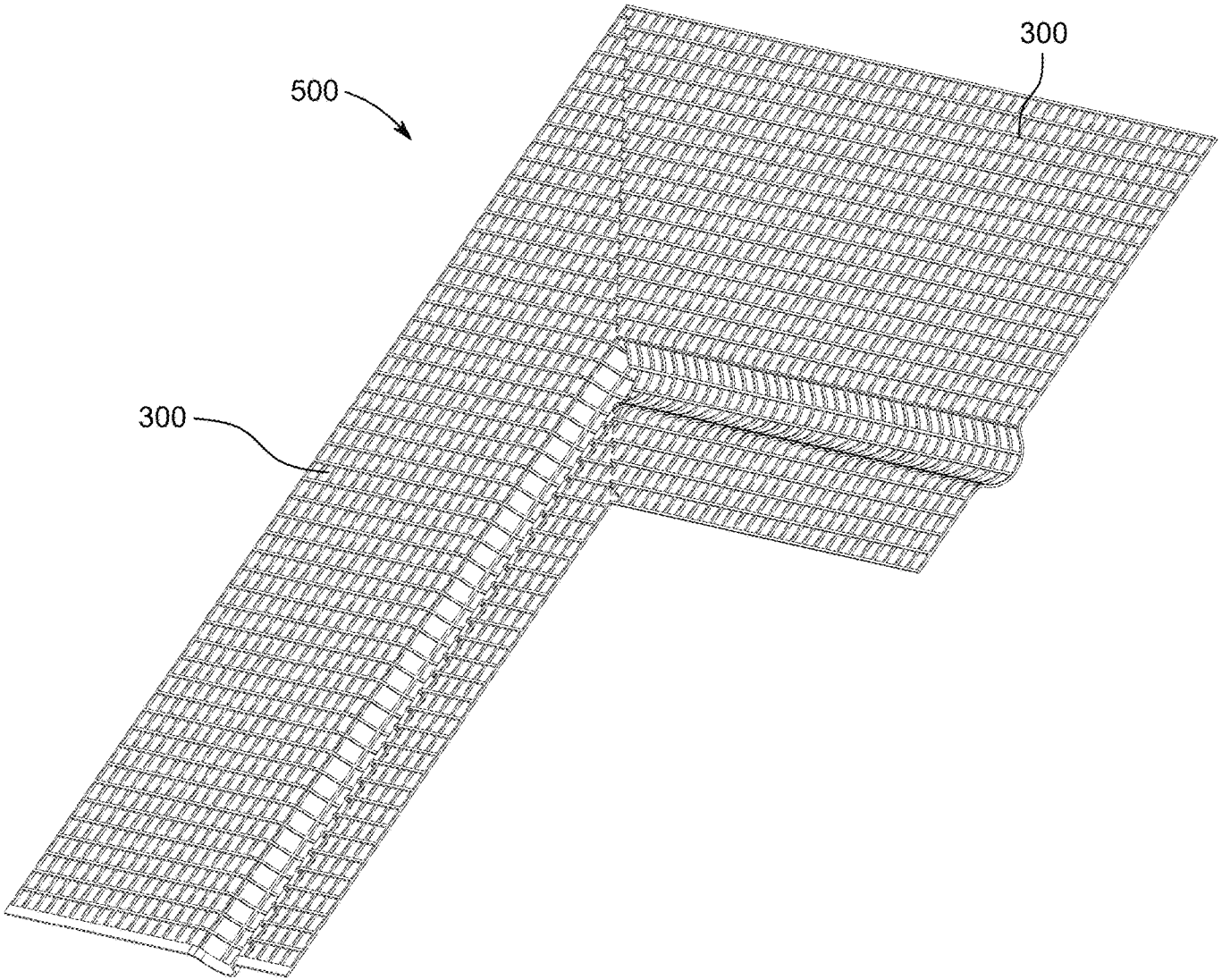
FIG. 11 schematically illustrates another perspective view of an inside corner screen assembly fabricated from screen assemblies of FIG. 3.

Rooflines often necessitate that rain gutters accommodate inside and outside corners to confirm with the perimeter of the roof. For these inside and outside corners, using unmodified straight gutter guard assemblies will not fully cover the rain gutter in such inside and outside corners. However, the gutter guard assemblies 400 can be modified to accommodate corners. As illustrated in FIGS. 10 and 11, two straight sections of the screen assembly 300 can be cut at an angle and abutted together to form a screen assembly 500 that can accommodate an inside corner. It will be understood that a similar arrangement with an opposite angle cut can modify the screen assemblies 300 to accommodate an outside corner of a rain gutter. In the illustrated example, the cut angle is forty-five degrees. This angle can be larger or smaller depending on the particular arrangement of the rain gutters.

Figure 12:
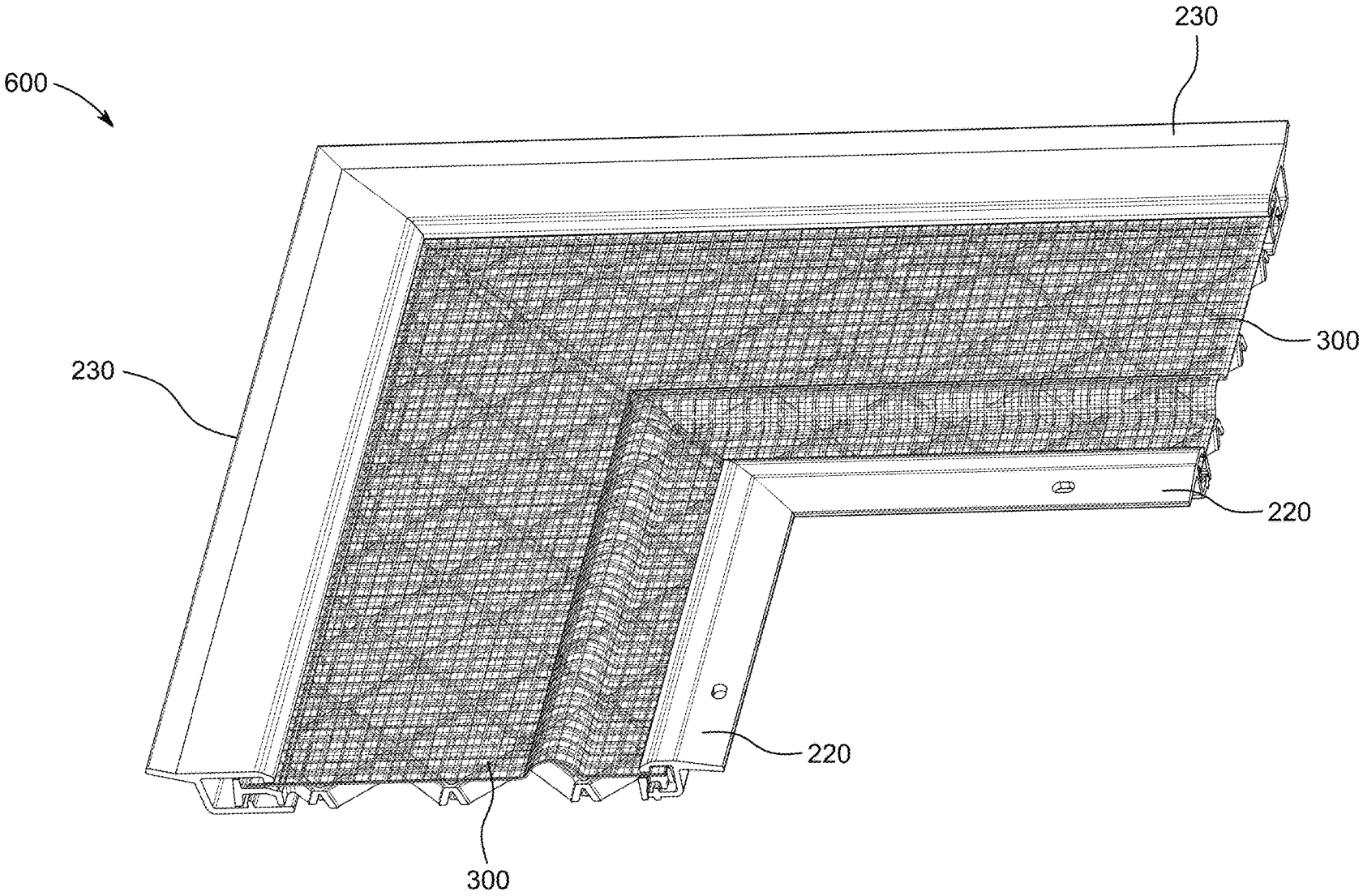
FIG. 12 schematically illustrates a perspective view of an inside corner gutter guard assembly using the components of the gutter guard system of FIG. 2 and screen assemblies of FIG. 10.
Figure 13:
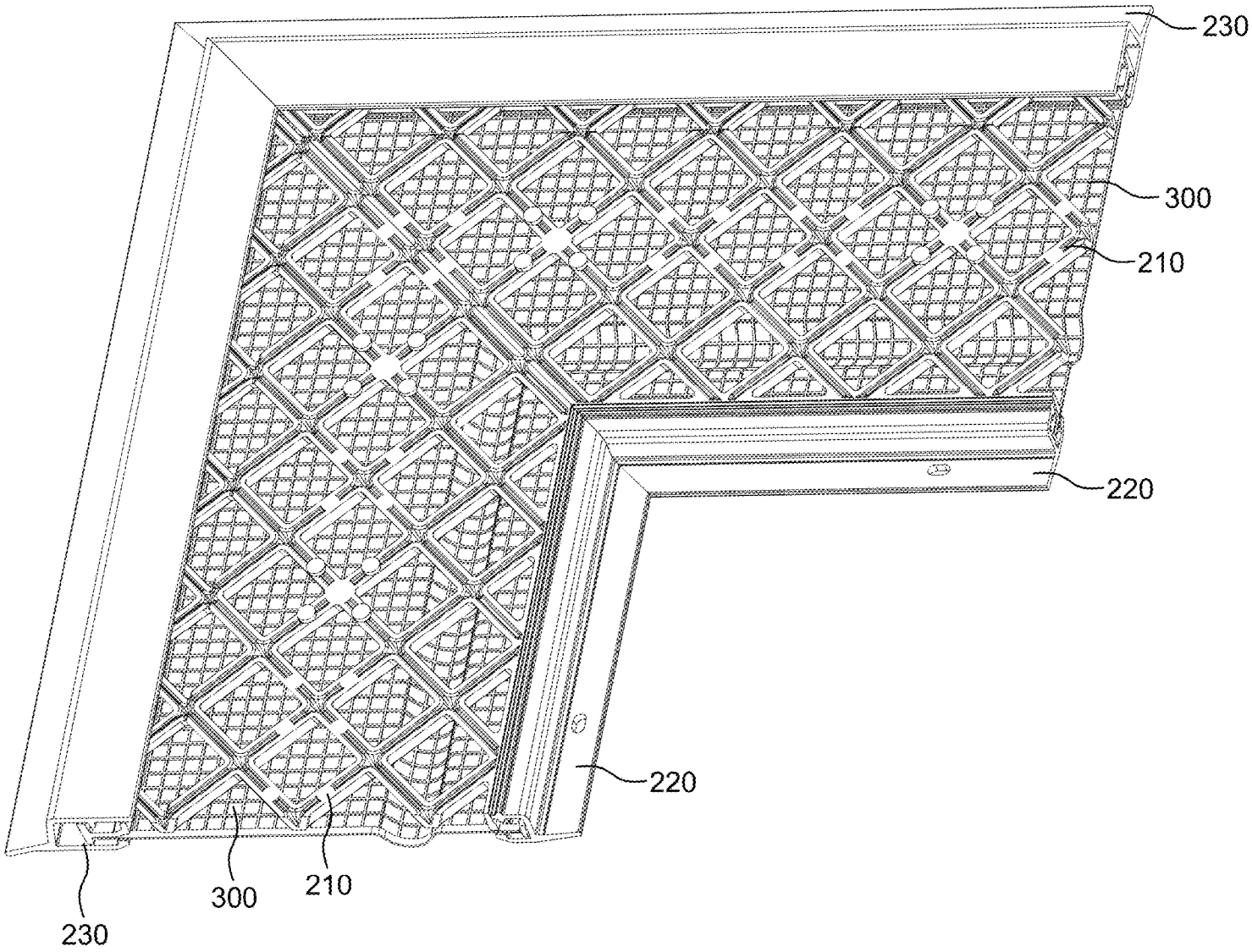
FIG. 13 schematically illustrates another perspective view of an inside corner gutter guard assembly using the components of the gutter guard system of FIG. 2 and screen assemblies of FIG. 10.

FIGS. 12 and 13 illustrate modified screen assemblies 300 assembled with components of a modular gutter guard system to form an inside corner gutter guard assembly 600. As noted above, the components of the gutter guard system are fabricated such that it is relatively easy to cut and trim a gutter guard assembly to facilitate an inside or outside corner using common tools. In another example, a screen assembly can be fabricated as a single component to accommodate an inside or outside corner. In such an example, the screen assembly would generally be arranged as illustrated in FIGS. 10 and 11. However, there would be no seam for two abutting components (because the screen assembly would be one integral assembly) and the raised section would not have an abrupt ninety degree transition but would instead include a rounded transition.

Figure 14:
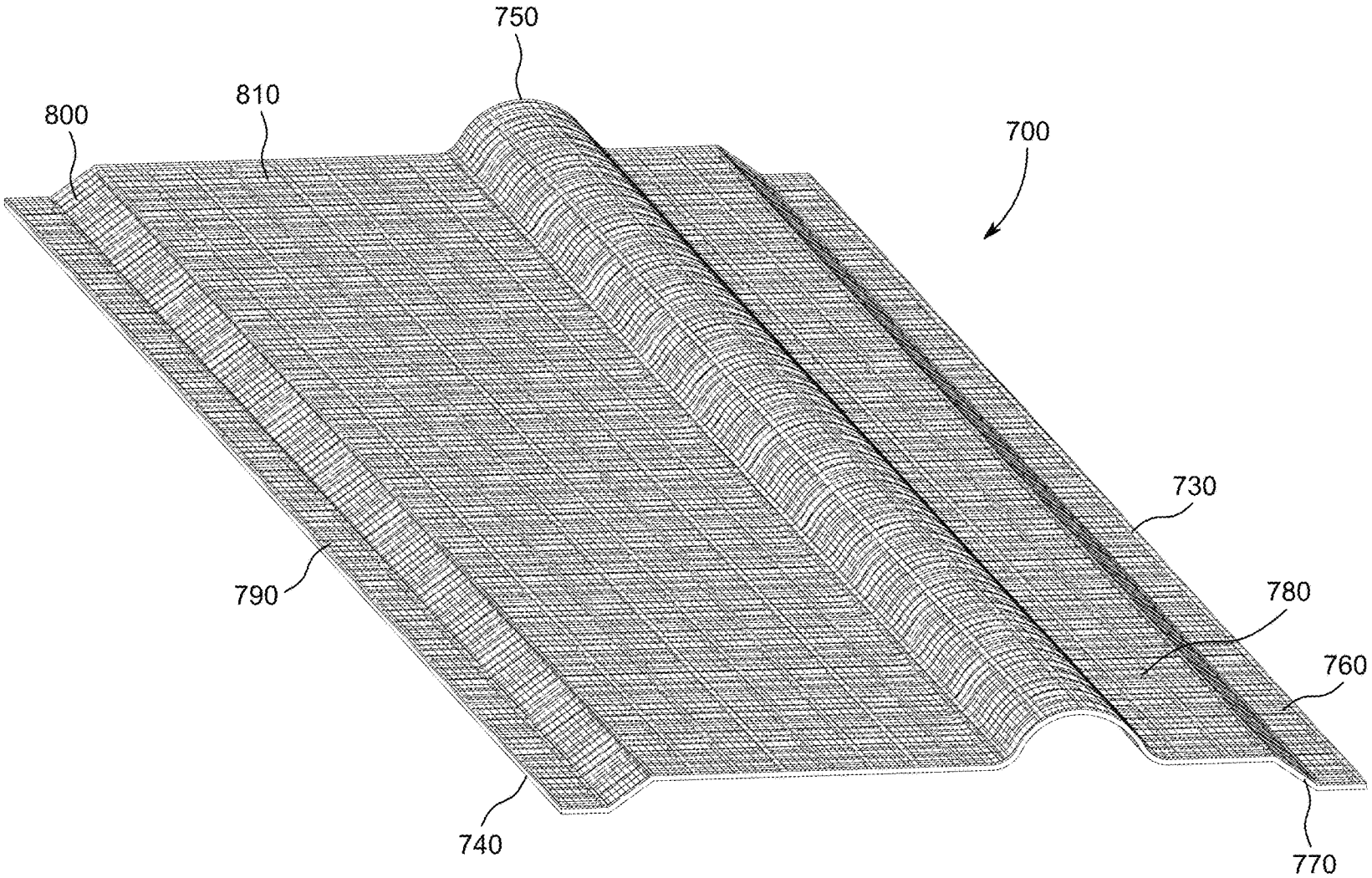
FIG. 14 schematically illustrates a perspective view of a second embodiment of a screen assembly for use with a gutter guard system.
Figure 15:
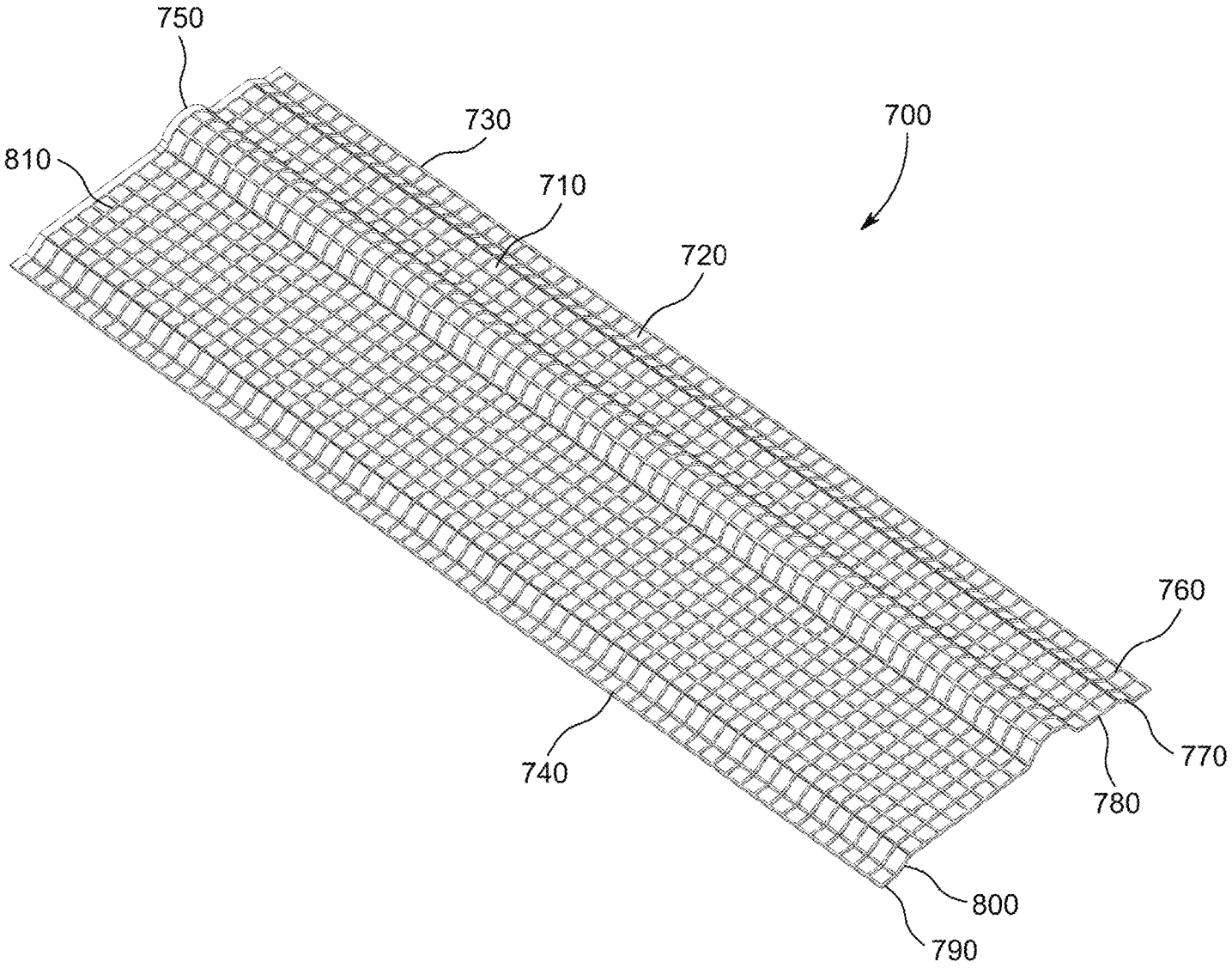
FIG. 15 schematically illustrates another perspective view of the screen assembly of FIG. 14.
Figure 16:
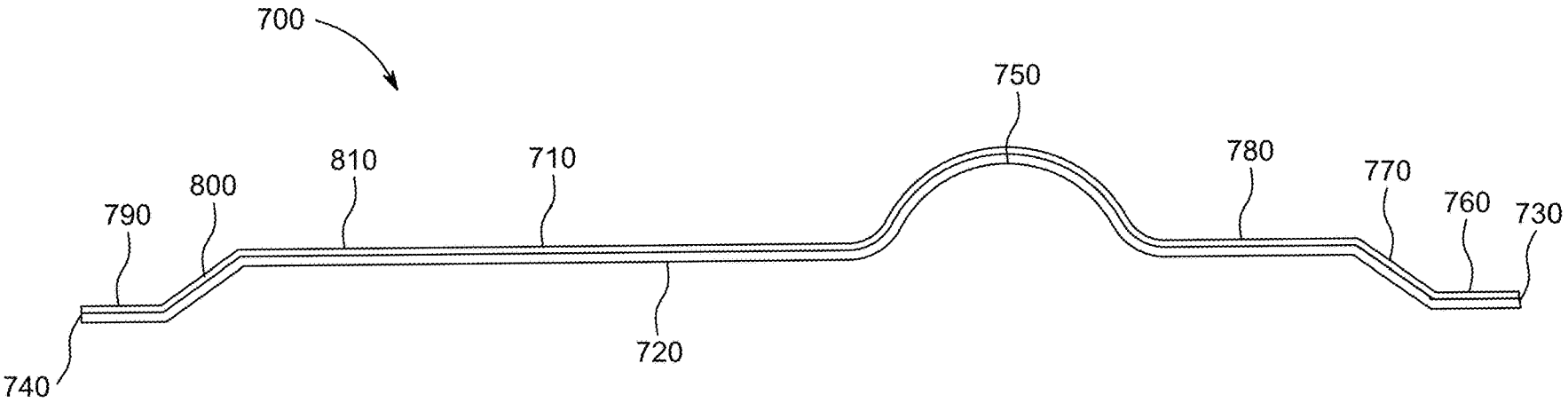
FIG. 16 schematically illustrates side view of the screen assembly of FIG. 14.

FIGS. 14-16 illustrate another embodiment of an alternative screen assembly 700. This screen assembly 700 is similar to the screen assembly 300 of FIGS. 3-6; however, this screen assembly 700 is designed to accommodate the gutter guard system 100 illustrated in FIG. 1. The screen assembly 700 comprising a mesh screen 710 and a grid 720. As with the earlier example, the mesh screen 710 is a 30 mesh metal screen made of 316L stainless steel wire that is 0.0085 inches in diameter arranged in a square weave such that there are 30 wires for each linear inch of mesh screen 310 in both the width and length directions. The grid 720 is a metal grid made of 316L stainless steel wire that is 0.0220 inches in diameter arranged in a matrix structure such that there are 4 wires for each linear inch of the grid 720 in both the width and length directions. The mesh screen 710 and grid 720 are secured together into the screen assembly 700 using any number of applicable techniques and methods. FIG. 14 is a topside perspective view of the screen assembly 700, FIG. 15 is a bottom side perspective view of the screen assembly 700 (where the mesh screen 710 can be seen through the openings of the grid 720), and FIG. 16 is a side view of the screen assembly 700.

The screen assembly 700 includes a front edge 730 and rear edge 740 with a raised section 750 positioned between the front edge 730 and rear edge 740 running along the length of the screen assembly 700 and generally parallel to the front 730 and rear 740 edges. The front 730 and rear 740 edges of the screen assembly 700 include structural features to accommodate the integrated front 120 and rear 130 receivers of the gutter guard system 100 of FIG. 1. The front edge 730 includes a flat tab 760 and an angled or transition section 770 that transitions into a relative short front section 780 that extends to the raised section 750. The rear edge 740 similarly includes a flat tab 790 and an angled or transition section 800 that transitions into a longer flat rear section 810 that extends to the raised section 750. The raised and rounded section 750 is positioned closer to the front edge 730 than the rear edge 740. As illustrated, the front 780 and rear 810 sections, the flat tabs 760, 790, and the transition sections 770, 800 extend along the longitudinal length of the screen assembly 700.

The raised section 750 is generally rounded and semi-circular in cross-section. The embodiment of the screen assembly 700 illustrated in FIGS. 14-16 is designed to accommodate a gutter guard system for a five inch rain gutter. In this embodiment, the overall width of the screen assembly 300 is approximately 3.625 inches, with the front section 360 approximately one inch in width, the rear section approximately three inches in width, and the raised section 350 is approximately 0.75 inches in width and approximately 0.75 inches in height. It will be understood that dimensions provide herein are mere examples of one arrangement of a screen assembly. The raised section can include different geometric arrangements and shapes than illustrated herein, and dimensions can be adjusted to accommodate varying widths of gutters and different climate conditions.

Figure 17:
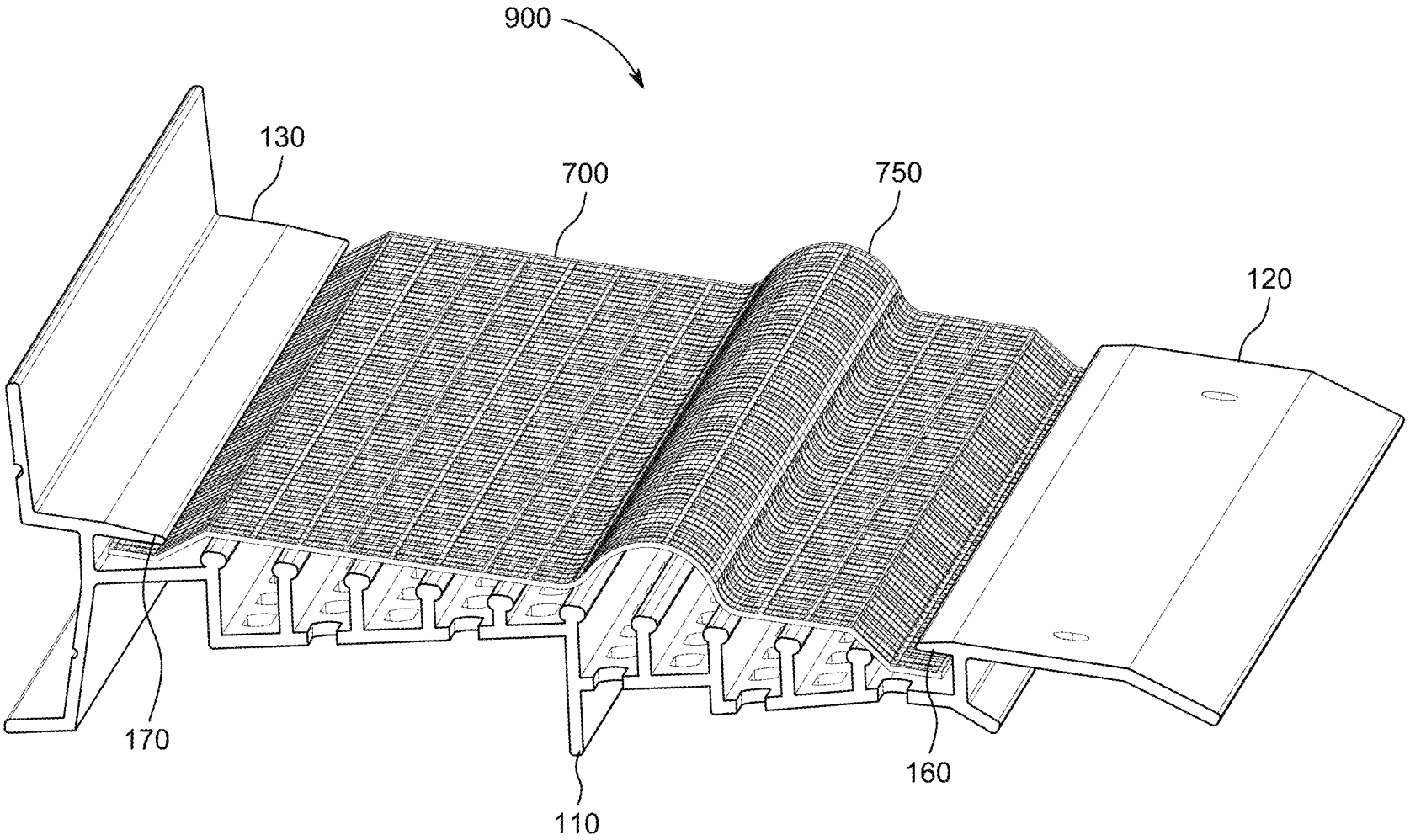
FIG. 17 schematically illustrates a perspective view of the gutter guard system of FIG. 1 with the screen assembly of FIG. 14.
Figure 18:
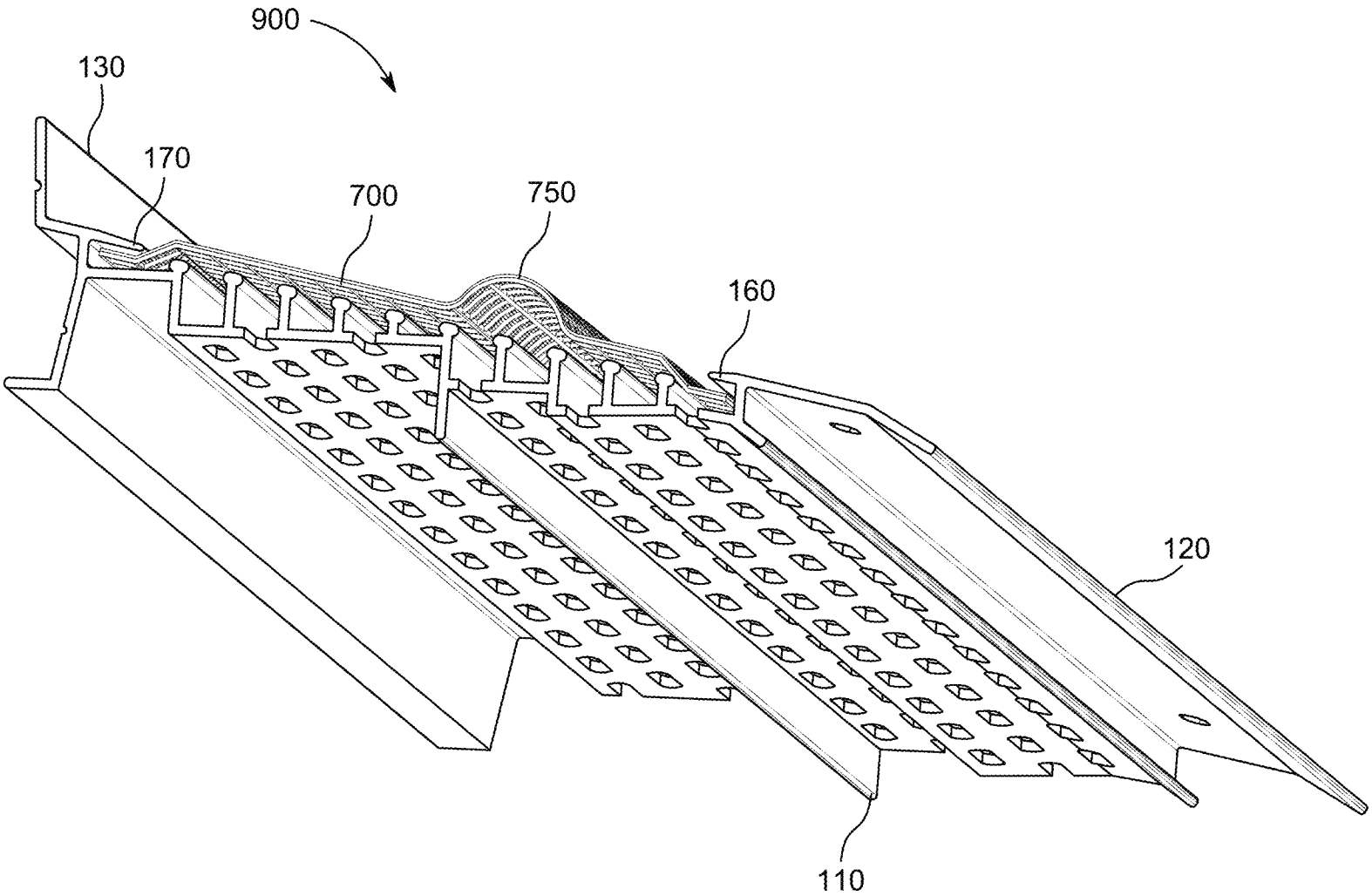
FIG. 18 schematically illustrates another perspective view of the gutter guard system of FIG. 1 with the screen assembly of FIG. 14.
Figure 19:
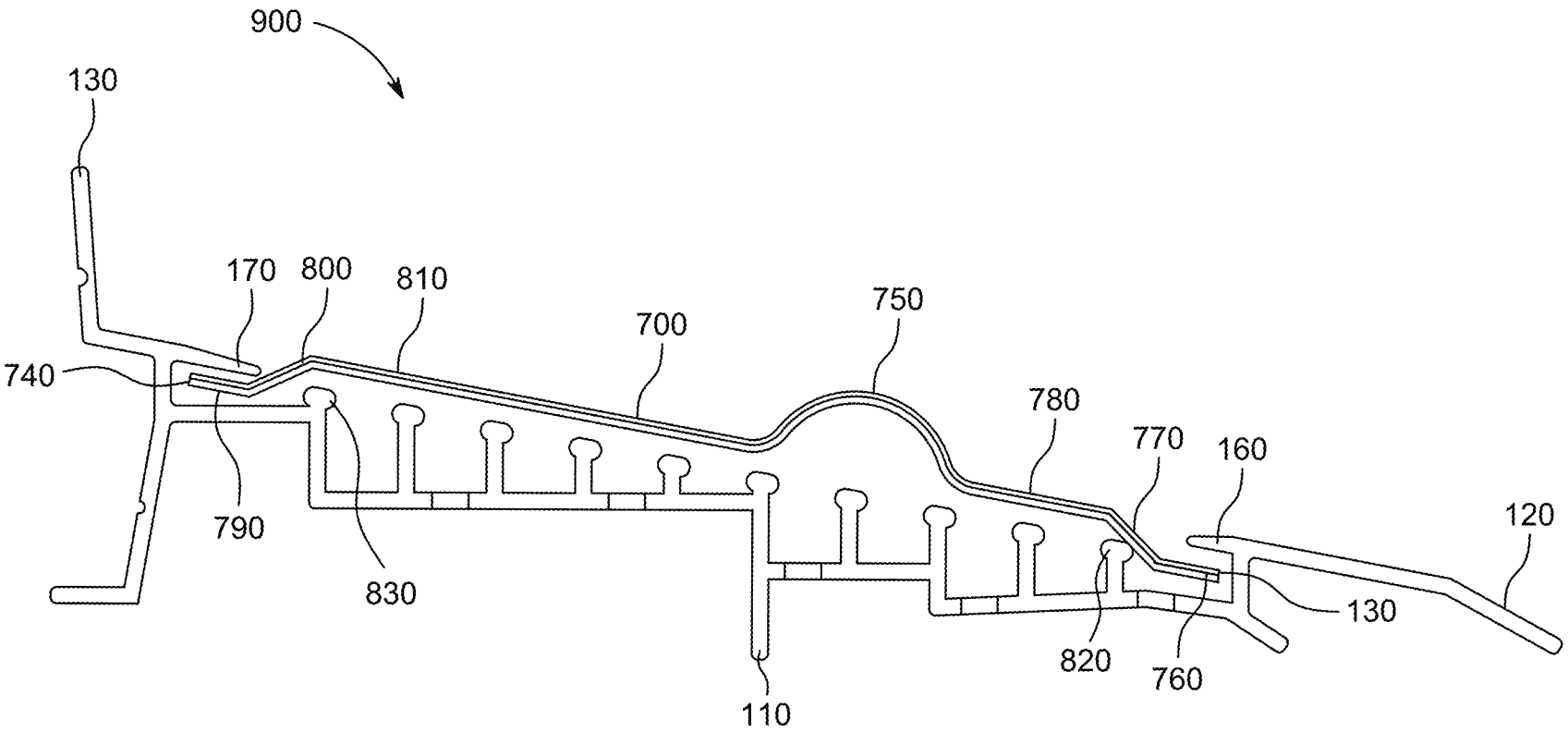
FIG. 19 schematically illustrates a side view of the gutter guard system of FIG. 1 with the screen assembly of FIG. 14.

FIGS. 17-19 illustrate two perspective views and a sided view of a novel gutter guard system 900 wherein the screen assembly 700 is assembled with the gutter guard system illustrated in FIG. 1. As best illustrated in the side view of FIG. 19, the front edge 730 of the screen assembly 700 is tucked under the interior extending edge 160 of the front receiver 120, and the rear edge 740 of the screen assembly 700 is tucked under the interior extending edge 170 of the rear receiver 130. As will be appreciated, the main body 110, front receiver 120, and rear receiver 130 are integrally formed into one component; therefore, inserting the screen assembly 700 (with a relatively rigid grid 720) under the extending edges (160, 170) of the front 120 and rear 130 receivers would necessitate deformation of the edges (730, 740) if the screen assembly 700 were flat (except for the raised section 750). However, the screen assembly 700 includes flat tabs 760, 790 and angled sections 770, 800 proximate to the front 730 and rear 740 edges. These flat tabs 760, 790 and angled sections 770, 800 facilitate the insertion of the screen assemblies 700 under the extending edges (160, 170) of the front 120 and rear 130 receivers. Specifically, as illustrated in FIG. 19, water management features (820, 830) located proximate to the front 120 and rear 130 receivers are positioned higher that the channels under the extending edges (160, 170). The flat tabs 760, 790 and angled sections 770, 800 are arranged to avoid contact or interference with these water management features (820, 830) while maintaining the majority of the screen assembly 700 generally parallel to the main body 110.

Once the gutter guard system 900 is assembled and installed onto a rain gutter, the screen assembly 700 is generally positioned on a downward angle from the rear receiver 130 to the front receiver 120. Such a downward angle accelerates the flowrate of rainwater across the screen assembly 700. The location and arrangement of the raised and rounded section 750 serves as a waterflow obstacle that slows the flowrate of rainwater across the screen assembly 700, which provides more time and opportunity for rainwater to pass downward through the screen and into the rain gutter. While the raised and rounded section 750 is illustrated and described as longitudinally extending the length of the screen assembly 700 and positioned generally closer to the front edge 730 than the rear edge 740, it will be understood that a raised and rounded section can be alternatively arranged and positioned elsewhere on the screen assembly or the screen may be arranged to have multiple raised and rounded sections.

The gutter guard assembly 900 can be fabricated and assembled in varying lengths with assemblies 900 positioned adjacent to one another in straight sections of rain gutters. The last gutter guard assembly 900 installed can have to be trimmed with common tools to match the actual length of the straight section of rain gutter.

Figure 20:
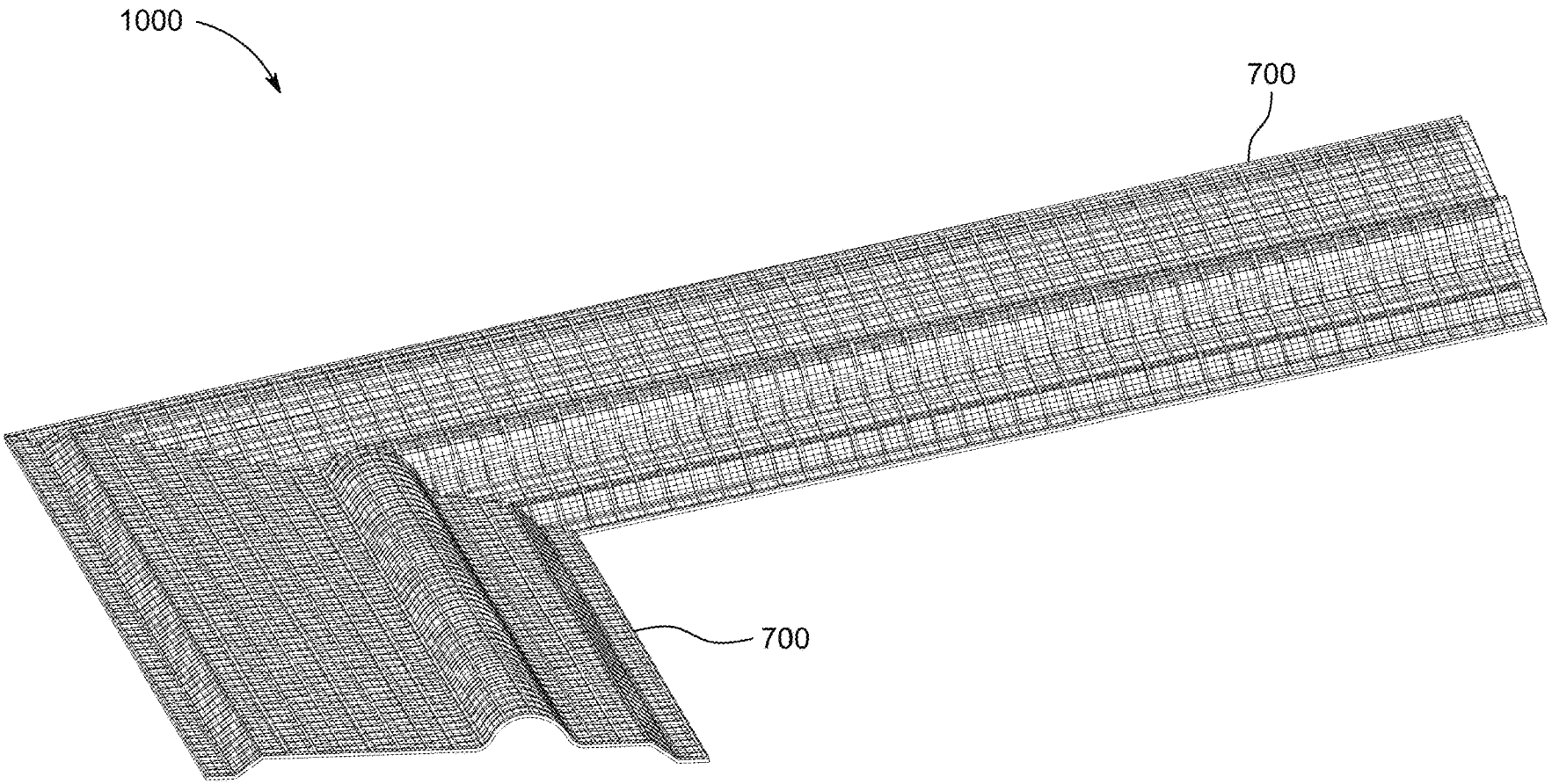
FIG. 20 schematically illustrates a perspective view of an inside corner screen assembly fabricated from screen assemblies of FIG. 14.
Figure 21:
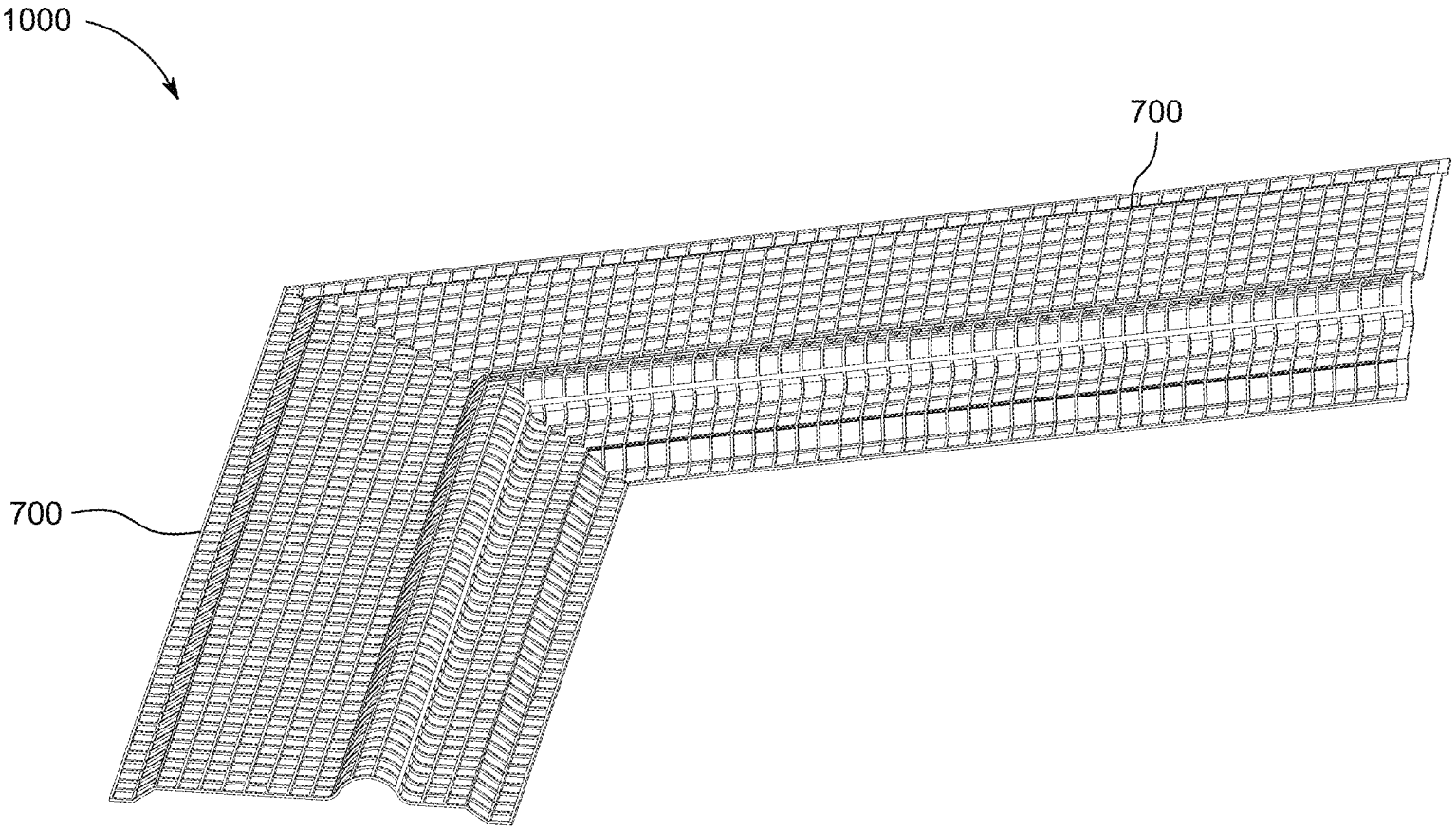
FIG. 21 schematically illustrates another perspective view of an inside corner screen assembly fabricated from screen assemblies of FIG. 14.
Figure 22:
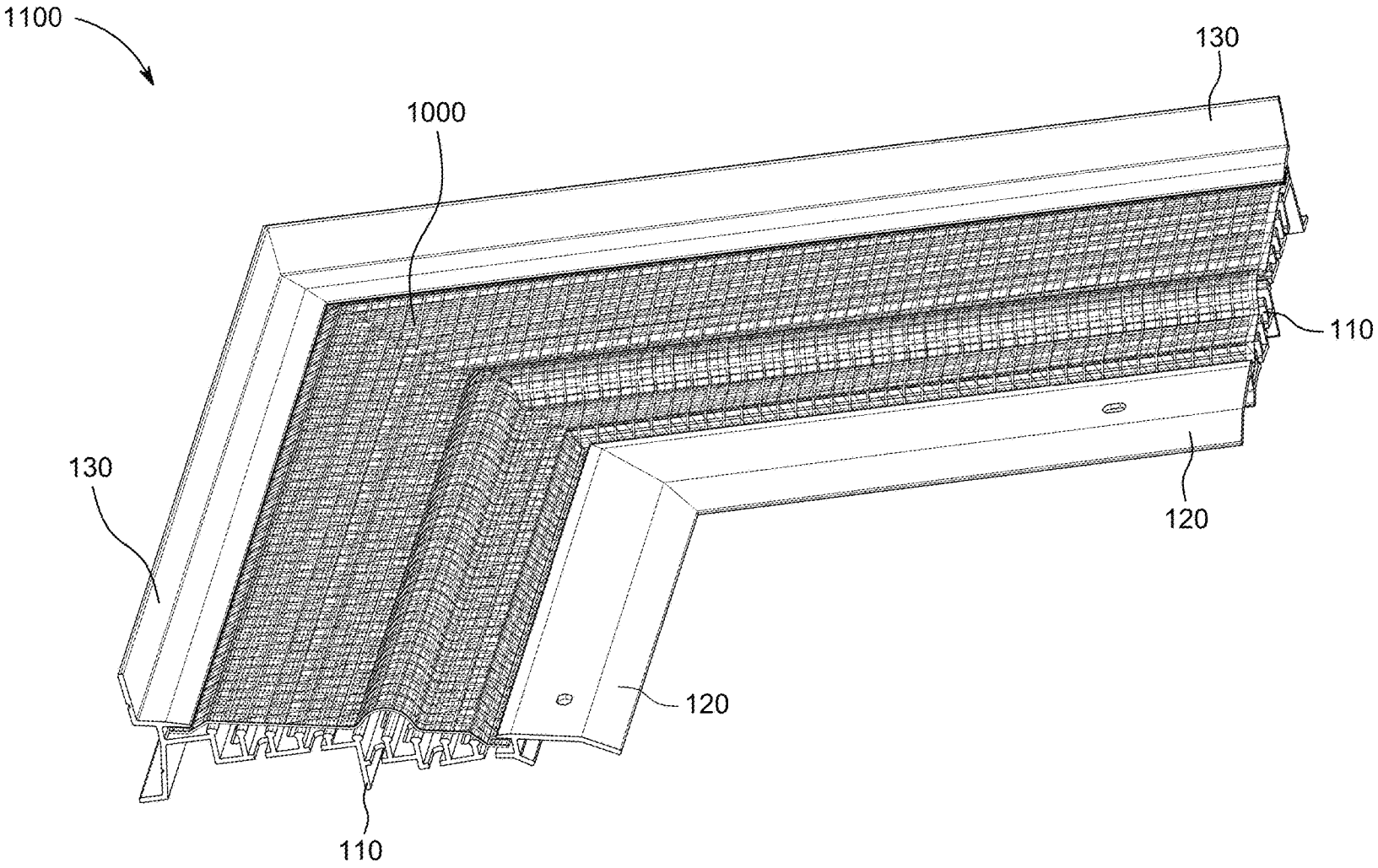
FIG. 22 schematically illustrates a perspective view of an inside corner gutter guard assembly using the components of the gutter guard system of FIG. 1 and screen assemblies of FIG. 14.
Figure 23:
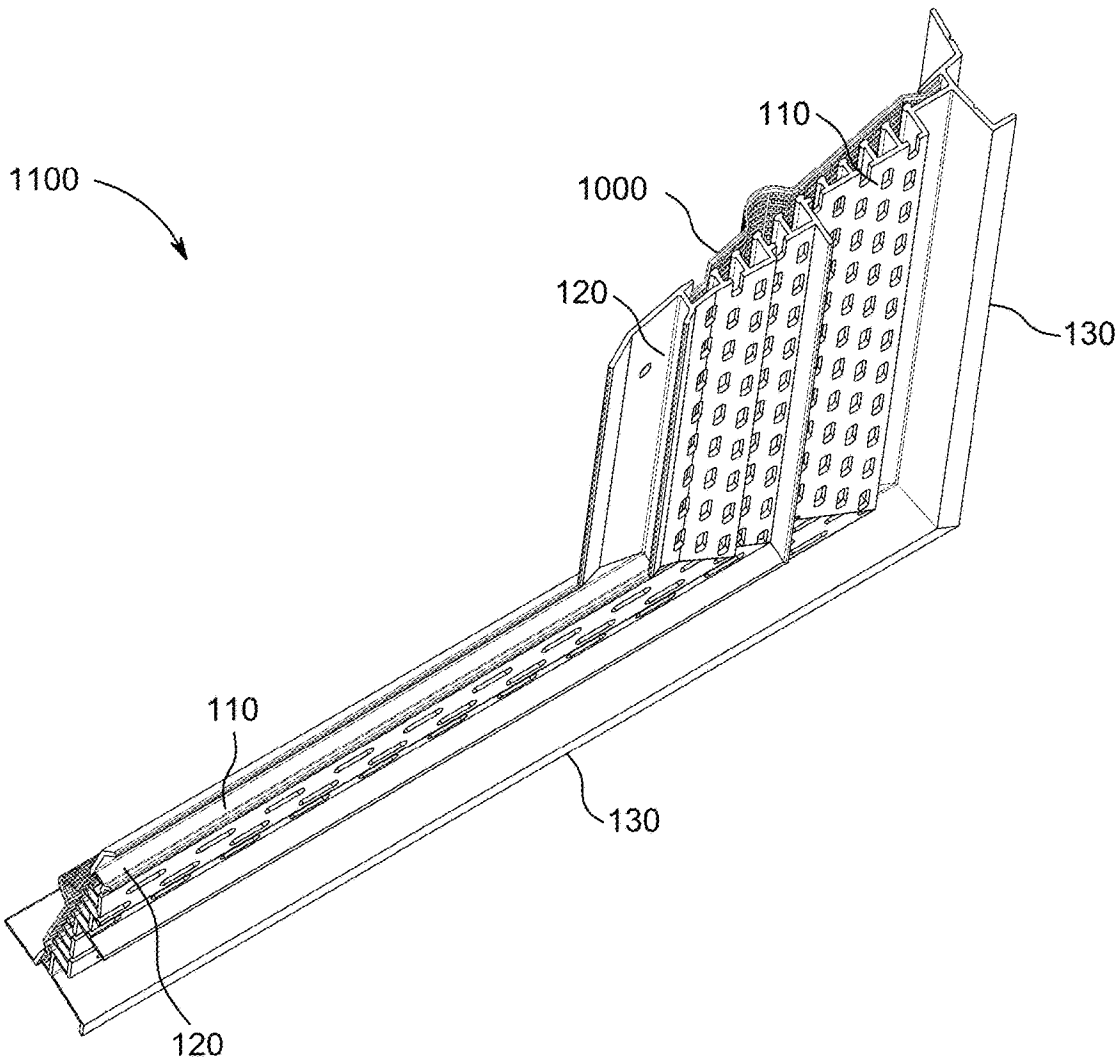
FIG. 23 schematically illustrates another perspective view of an inside corner gutter guard assembly using the components of the gutter guard system of FIG. 1 and screen assemblies of FIG. 14.

Similar to previous description, the gutter guard assemblies 900 can be modified to accommodate inside and outside rain gutter corners. As illustrated in FIGS. 20 and 21, two straight sections of the screen assembly 900 can be cut at an angle and abutted together to form a screen assembly 1000 that can accommodate an inside corner. It will be understood that a similar arrangement with an opposite angle cut can modify the screen assemblies 900 to accommodate an outside corner of a rain gutter. On the illustrated example, the cut angle is forty-five degrees, but this angle can be larger or smaller depending on the particular arrangement of the rain gutters. FIGS. 22 and 23 illustrate modified screen assemblies 900 assembled as an inside corner gutter guard assembly 1100. The components of the gutter guard system are fabricated such that it is relatively easy to cut and trim a gutter guard assembly to facilitate an inside or outside corner using common tools. In another example, a screen assembly can be fabricated as a single component to accommodate an inside or outside corner of a rain gutter.

Figure 24:
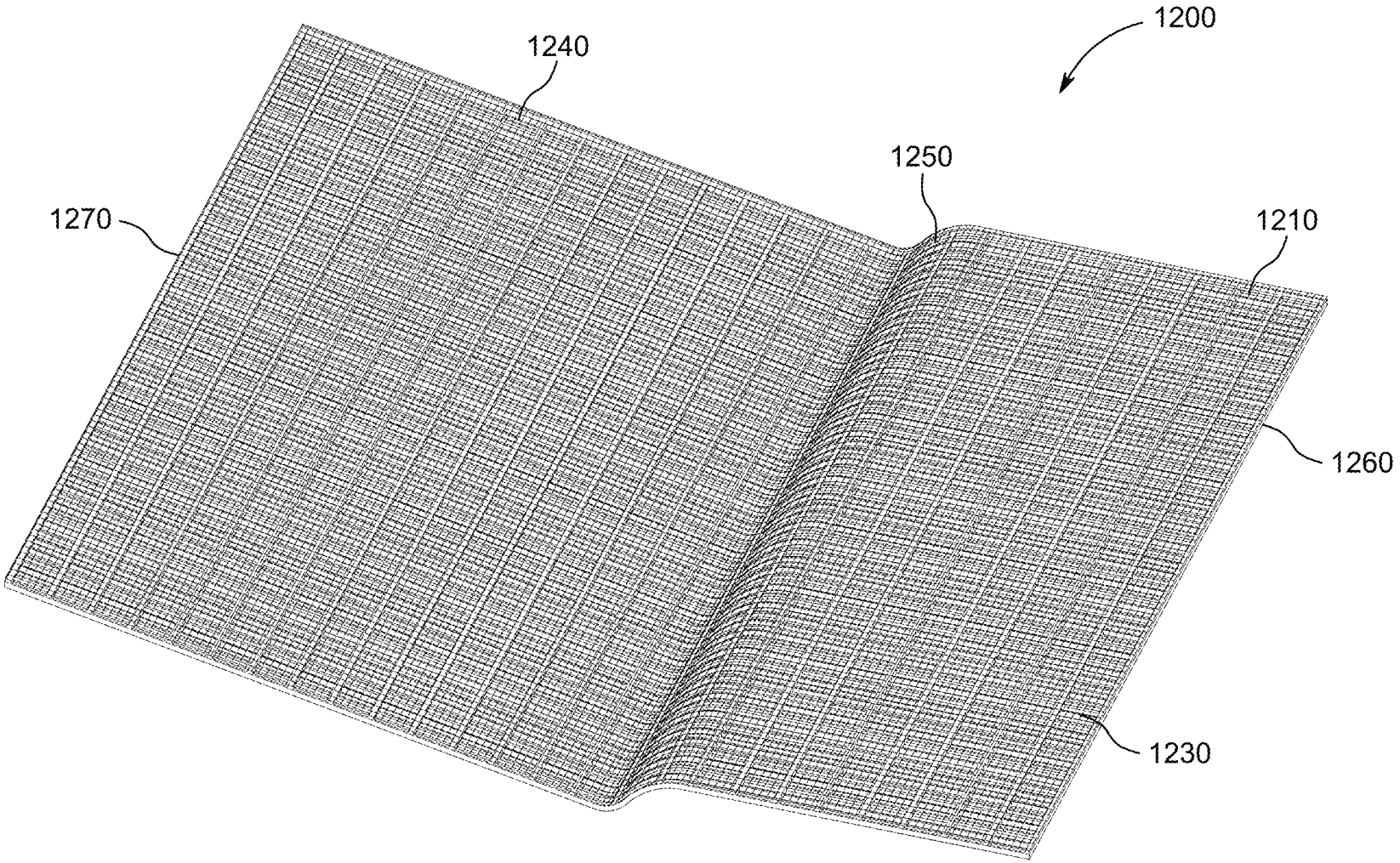
FIG. 24 schematically illustrates a perspective view of a third embodiment of a screen assembly for use with a gutter guard system.
Figure 25:
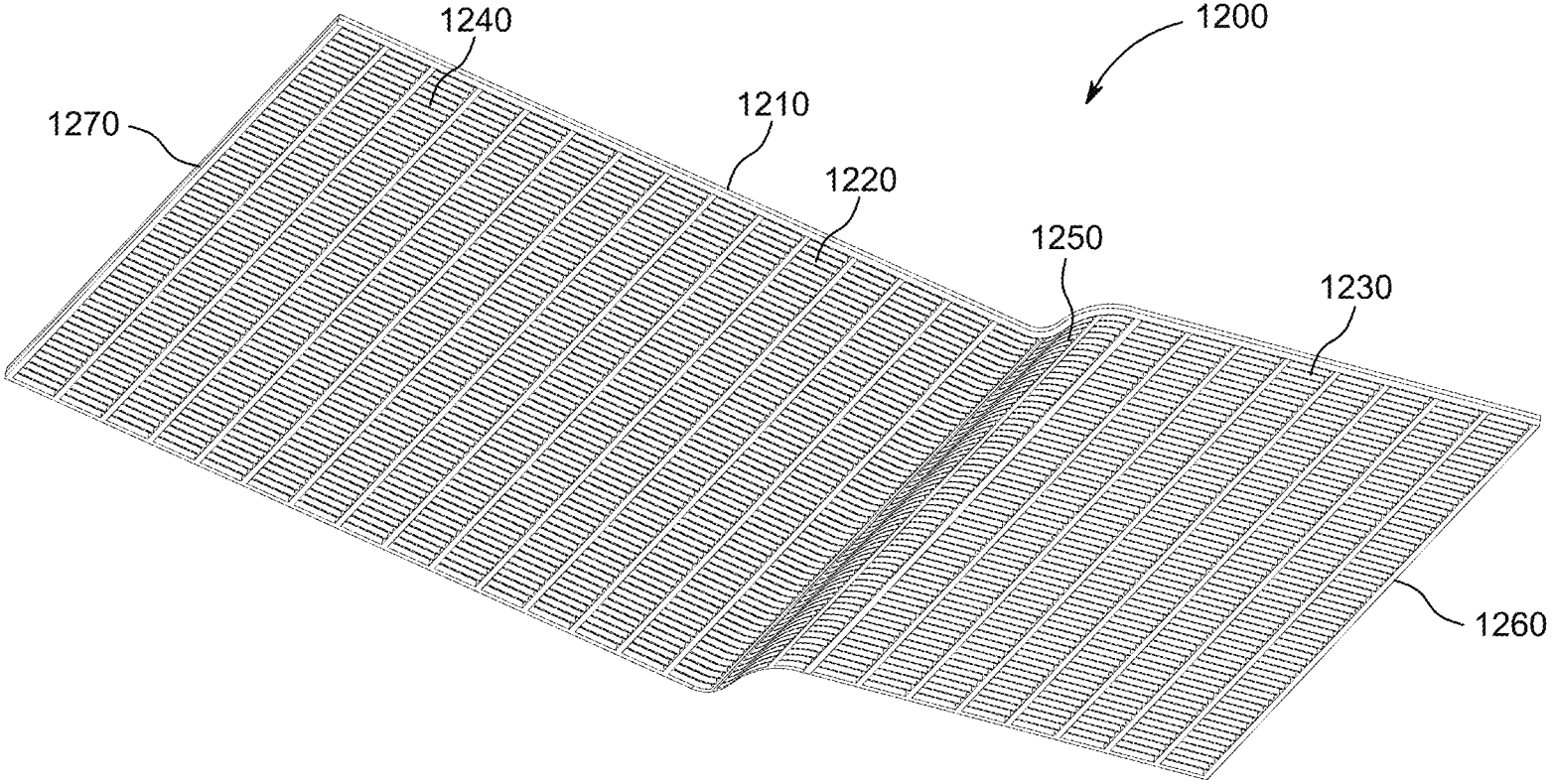
FIG. 25 schematically illustrates another perspective view of the screen assembly of FIG. 24.
Figure 26:
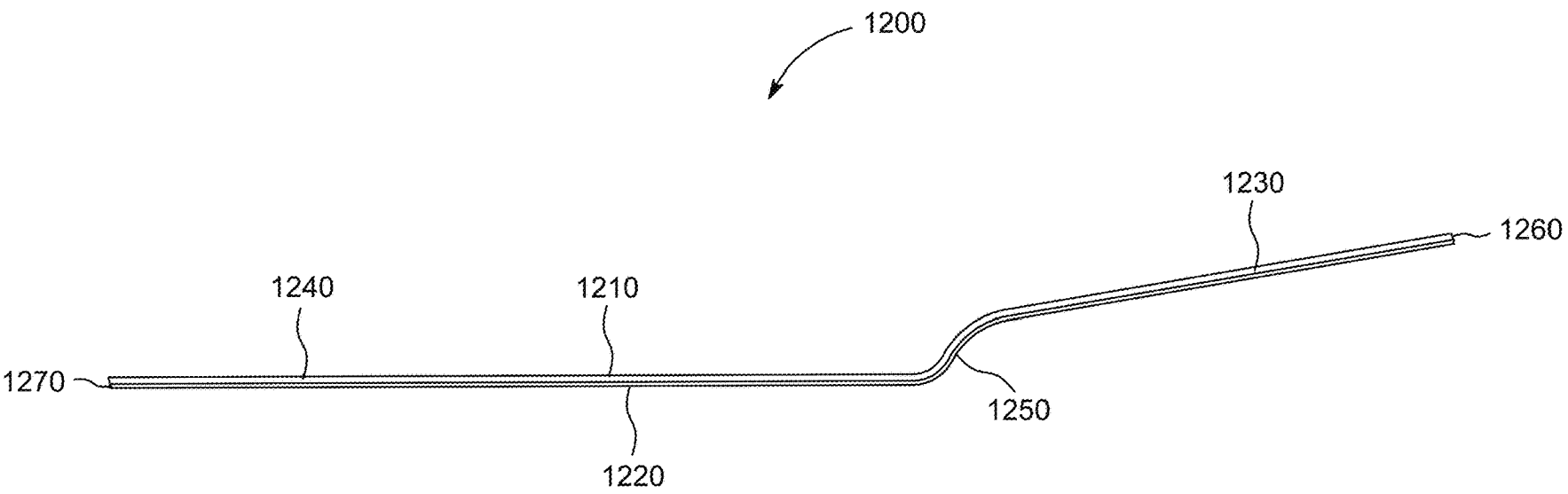
FIG. 26 schematically illustrates side view of the screen assembly of FIG. 24.

FIGS. 24-26 illustrate two perspective views and a sided view of a novel screen assembly 1200 that can be assembled with the gutter guard system illustrated in FIG. 1 or the gutter guard system illustrated in FIG. 2. The screen assembly 1200 comprising a mesh screen 1210 and a grid 1220 as previously described. FIG. 24 is a topside perspective view of the screen assembly 1200, FIG. 25 is a bottom side perspective view of the screen assembly 1200 (where the mesh screen 1210 can be seen through the openings of the grid 1220), and FIG. 26 is a side view of the screen assembly 1200. The screen assembly 1200 includes a front section 1230, a rear section 1240, and a transition section 1250 positioned between the front 1230 and rear 1240 sections. The front section 1230 extends from the front edge 1260 of the screen assembly 1200 to the transition section 1250, and the rear section 1240 extends from the rear edge 1270 of the screen assembly 1200 to the transition section 1250. The front 1230 and rear 1240 sections are generally rectangular and flat is shape and extend along the longitudinal length of the screen assembly 1200. When assembled, the rear edge 1270 of the screen assembly 1200 will be positioned within the rear receiver of the gutter guard system, and the front edge 1260 of the screen assembly 1200 will be positioned within the front receiver of the gutter guard system. As best illustrated in FIG. 26, the front section 1230 and rear section 1240 are arranged at an angle to one another. The rear section 1240 is generally larger than the front section 1230, and both front 1230 and rear 1240 sections are substantially larger than the transition section 1250. The screen 1200 is in part assembled to a gutter guard system through the use of an adapter (as further described herein). In such an arrangement, the transition section 1250 is positioned closer to the front edge 1260 than the rear edge 1270.

Figure 27:
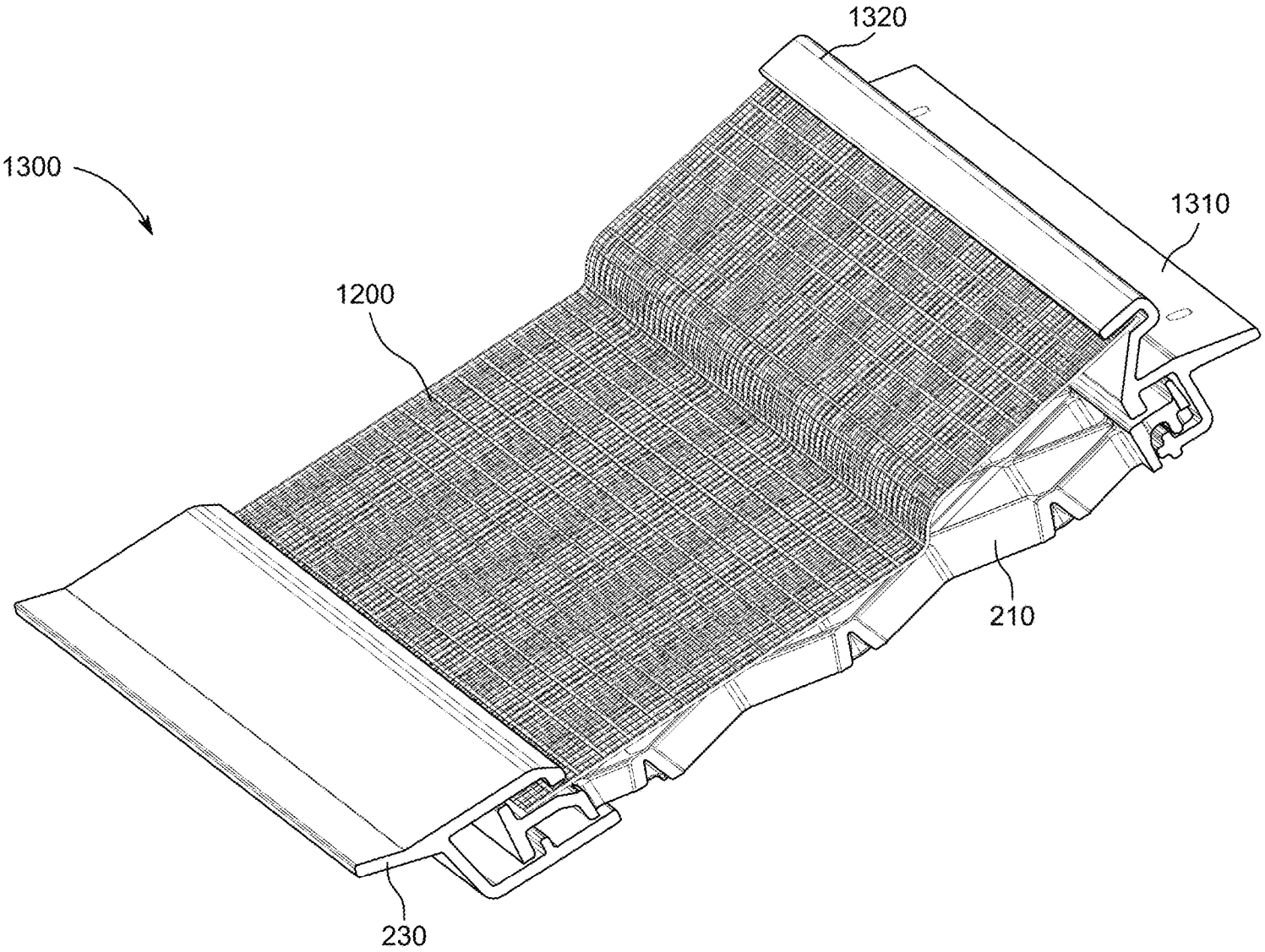
FIG. 27 schematically illustrates a perspective view of the gutter guard system of FIG. 2 with the screen assembly of FIG. 24.
Figure 28:
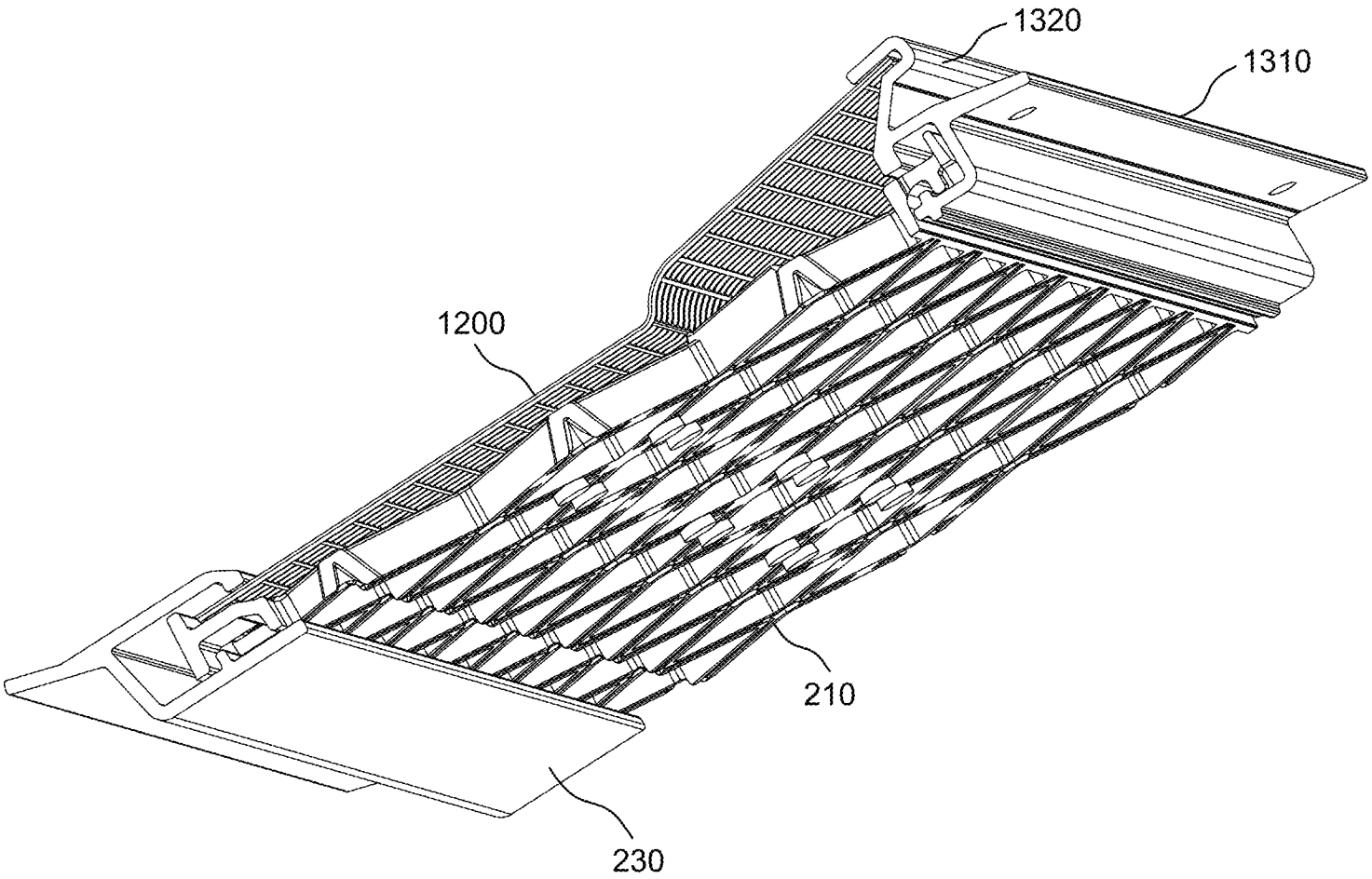
FIG. 28 schematically illustrates another perspective view of the gutter guard system of FIG. 2 with the screen assembly of FIG. 24.
Figure 29:
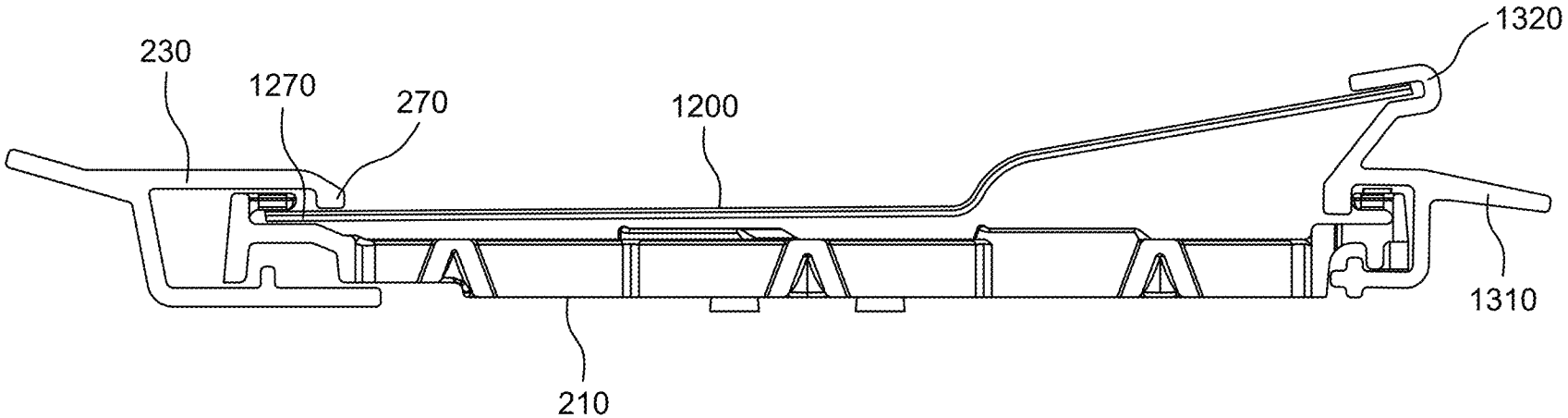
FIG. 29 schematically illustrates a side view of the gutter guard system of FIG. 2 with the screen assembly of FIG. 24.

FIGS. 27-29 illustrate two perspective views and a sided view of a novel gutter guard system 1300 wherein the screen assembly 1200 of FIGS. 23-26 is assembled with a novel front receiver 1310 and the rear receiver 230 and and main body 210 of the gutter guard system illustrated in FIG. 2. As will be more fully described below, the front receiver 1310 includes an integrated adapter 1320 that extends upward from the body of the front receiver 1320 to engage and secure the front edge 1260 of the screen assembly 1200. As best illustrated in the side view of FIG. 29, the rear edge 1270 of the screen assembly 1200 is tucked under the interior extending edge 270 of the rear receiver 290. In such an arrangement, the transition section 1250 extends longitudinally along the width of the screen assembly 1200 and is generally positioned between the front receiver 1310 and rear receiver 230, but closer to the front receiver 1310 once assembled with the gutter guard system 1300.

The combination of the transition section 1250 form an obstacle to rainwater flowing across the gutter guard system 1300. In addition, the front section 1230 of the screen assembly 1200, which is angled upward, can further form an obstacle to rainwater flowing across the gutter guard system 1300. Such obstacles slows the flowrate of the rainwater, which causes the rainwater to remain on the screen assembly 1200 for a longer period of time and causes more rainwater to pass through the screen assembly 1200 and into the rain gutter.

Figure 30:
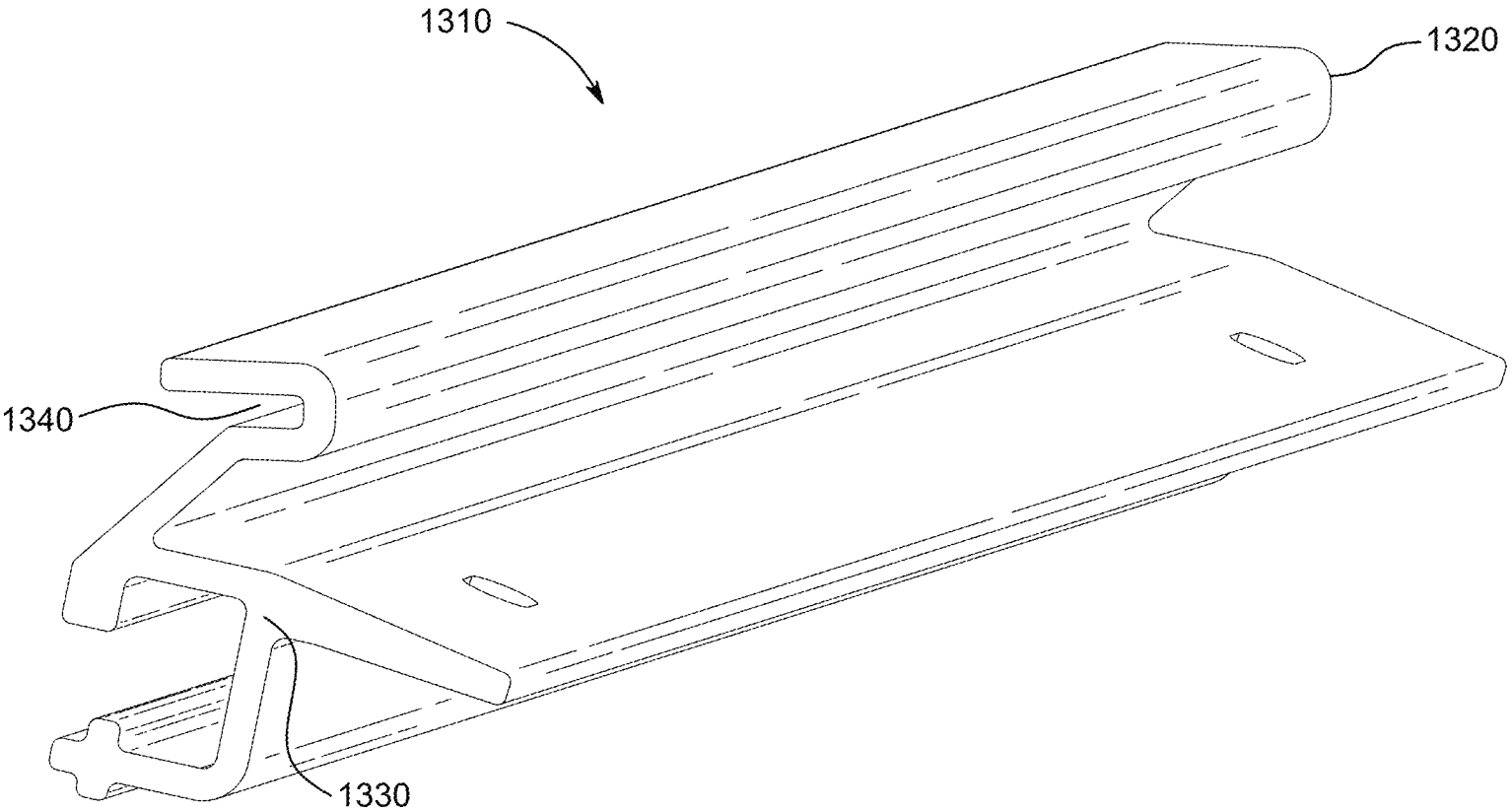
FIG. 30 schematically illustrates a perspective view of an adaptor for use with the screen assembly of FIG. 24.
Figure 31:
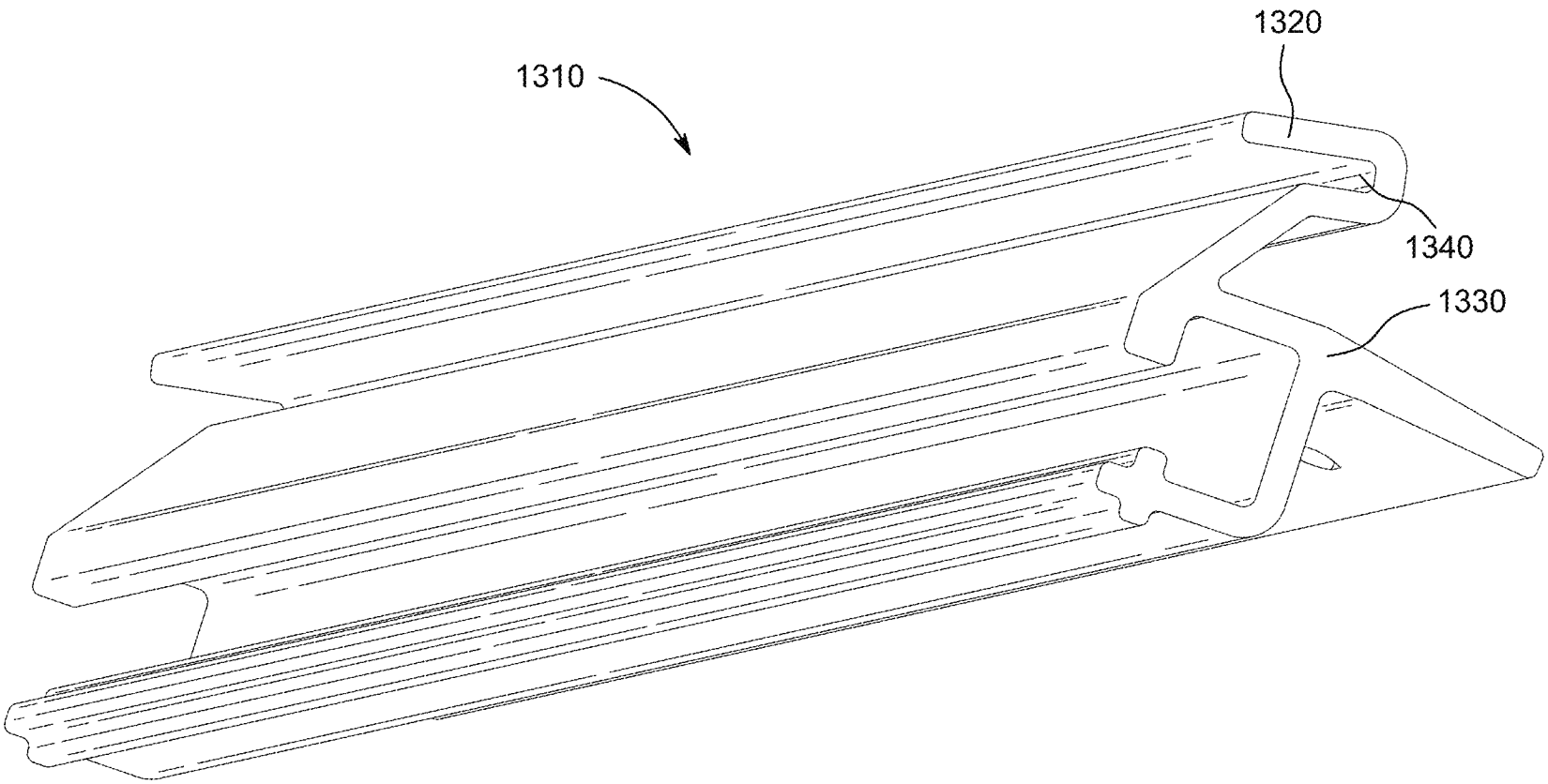
FIG. 31 schematically illustrates another perspective view of an adaptor for use with the screen assembly of FIG. 24.
Figure 32:
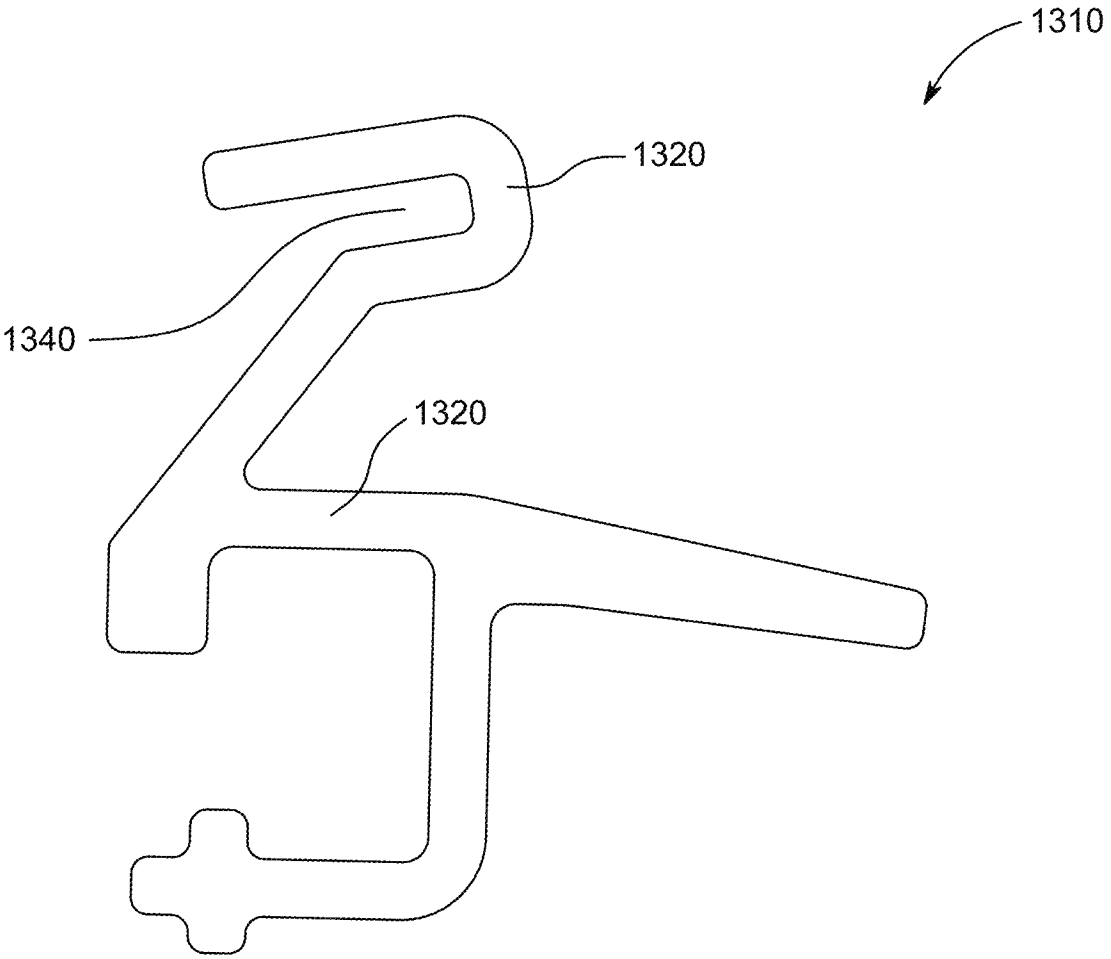
FIG. 32 schematically illustrates a side view of an adaptor for use with the screen assembly of FIG. 24.

FIGS. 30-32 illustrate two perspective views and a side view of the front receiver 1310. The front receiver 1310 shares similarities with the front receiver 220 of FIG. 2; however, it includes an adaptor 1320 extended upward from the body 1330 of the front receiver 1310. It will be appreciated that because the front section 1230 of the screen assembly 1200 is angled upwards relative the rest of the screen assembly 1200, the front receiver 1310 requires an adaptor 1320 that extends upward to capture and secure the front edge 1260 of the screen assembly 1200. The adaptor 1320 includes a longitudinal channel 1340 that is arranged to engage with and secure the front edge 1260 of the screen assembly 1200. Once the assembled gutter guard system 1300 is installed onto a rain gutter, the rear receiver 230 is positioned on the rear portion of the rain gutter and the front receiver 1310 is positioned on the front portion of the rain gutter. This typically results in the main body 210 of the gutter guard system 1300 positioned at a downward angle from the rear of the rain gutter to the front of the rain gutter. When in such an arrangement, the transition section 1250 and potentially the front section 1230 of the screen assembly 1200 remain on an upward incline, which provides resistance to the flow of rainwater across the screen assembly 1200.

Figure 33:
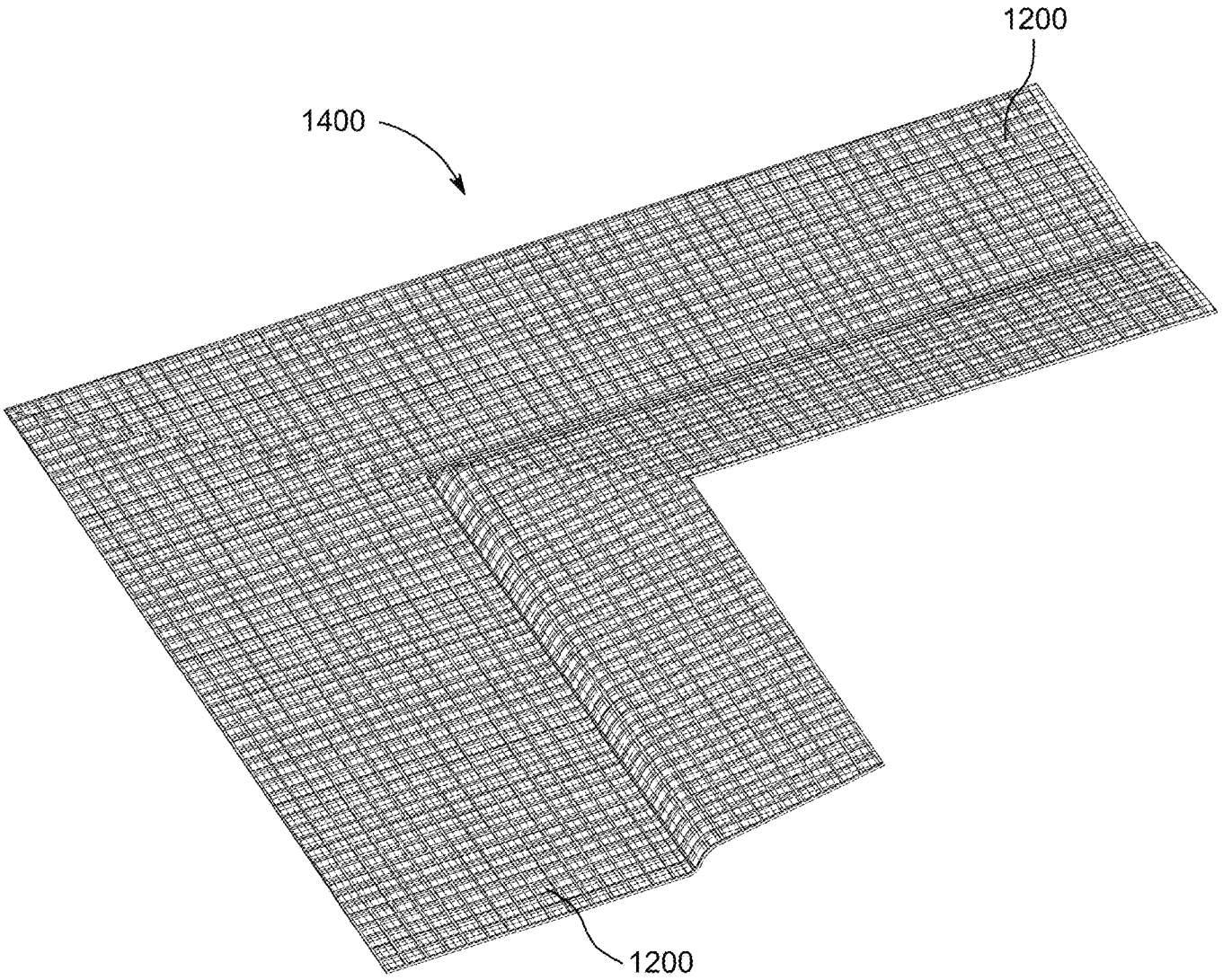
FIG. 33 schematically illustrates a perspective view of an inside corner screen assembly fabricated from screen assemblies of FIG. 24.
Figure 34:
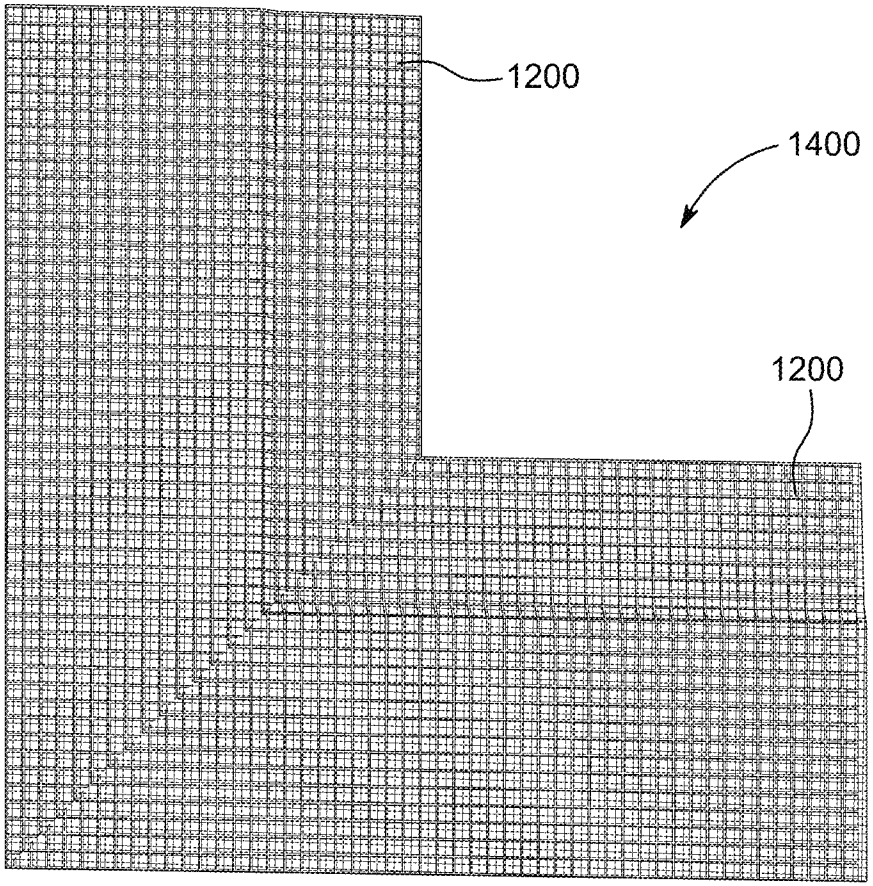
FIG. 34 schematically illustrates another perspective view of an inside corner screen assembly fabricated from screen assemblies of FIG. 24.
Figure 35:
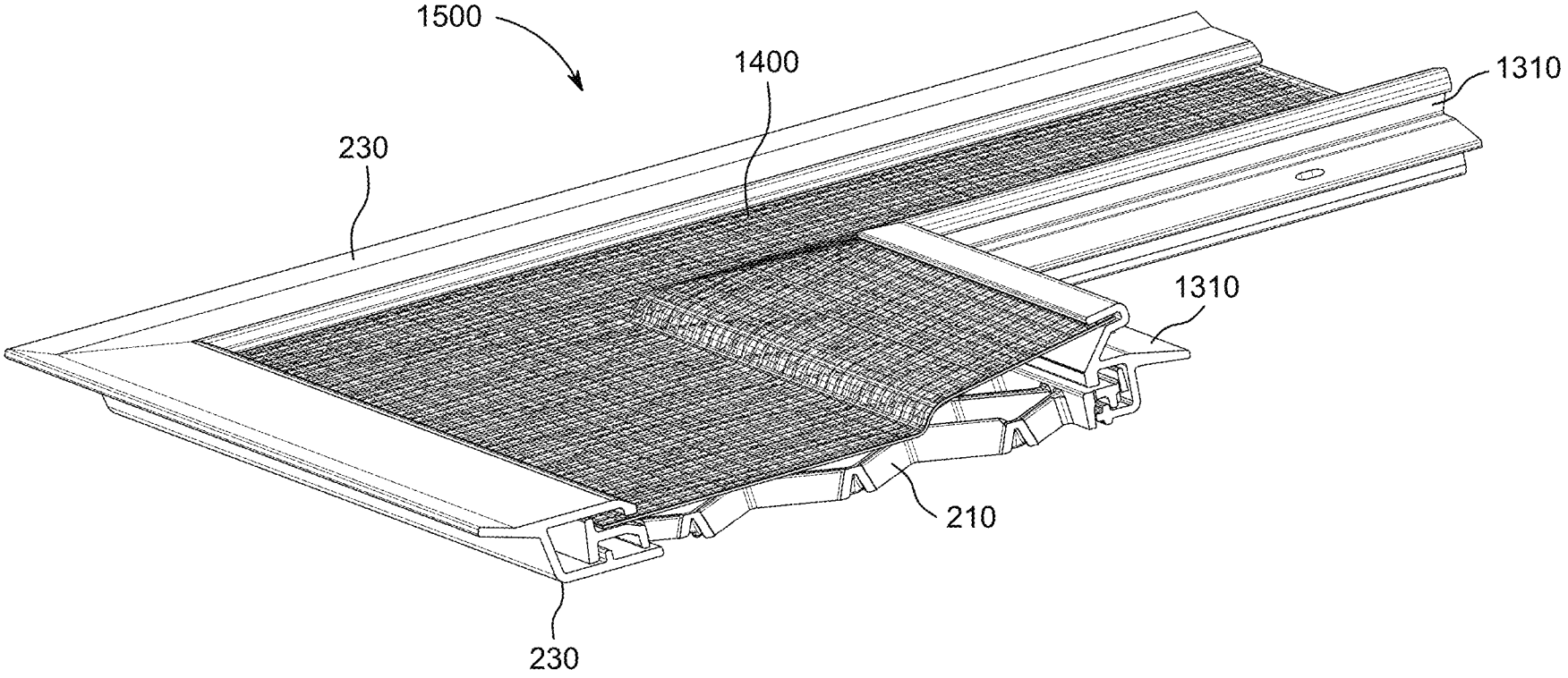
FIG. 35 schematically illustrates a perspective view of an inside corner gutter guard assembly using the components of the gutter guard system of FIG. 2 and screen assemblies of FIG. 33.
Figure 36:
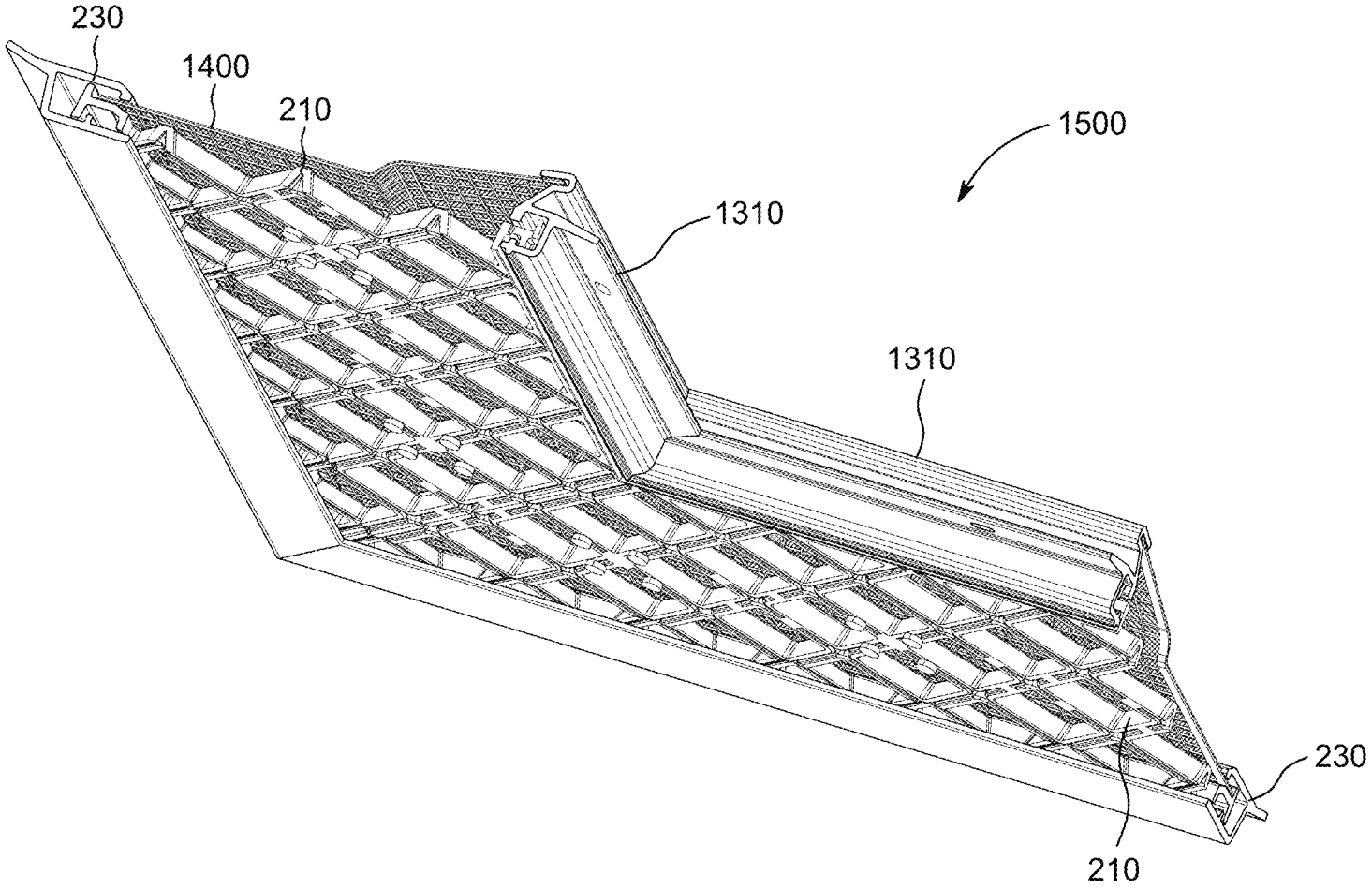
FIG. 36 schematically illustrates another perspective view of an inside corner gutter guard assembly using the components of the gutter guard system of FIG. 2 and screen assemblies of FIG. 33.

As with previous embodiments, the components for the gutter guard assembly 1300 can be fabricated and assembled in varying lengths and can be installed adjacent to one another in straight sections of rain gutters with the last assembly trimmed to fit using common tools. For inside corners, as illustrated in FIGS. 33 and 34, two straight sections of the screen assembly 1200 can be cut at an angle and abutted together to form a screen assembly 1400 that can accommodate an inside corner. A similar arrangement with an opposite angle cut can modify the screen assemblies 1200 to accommodate an outside corner of a rain gutter. FIGS. 35 and 36 illustrate modified screen assemblies 1400 assembled with components of a modular gutter guard system to form an inside corner gutter guard assembly 1500. In another example, a screen assembly can be fabricated as a single component to accommodate an inside or outside corner.

Figure 37:
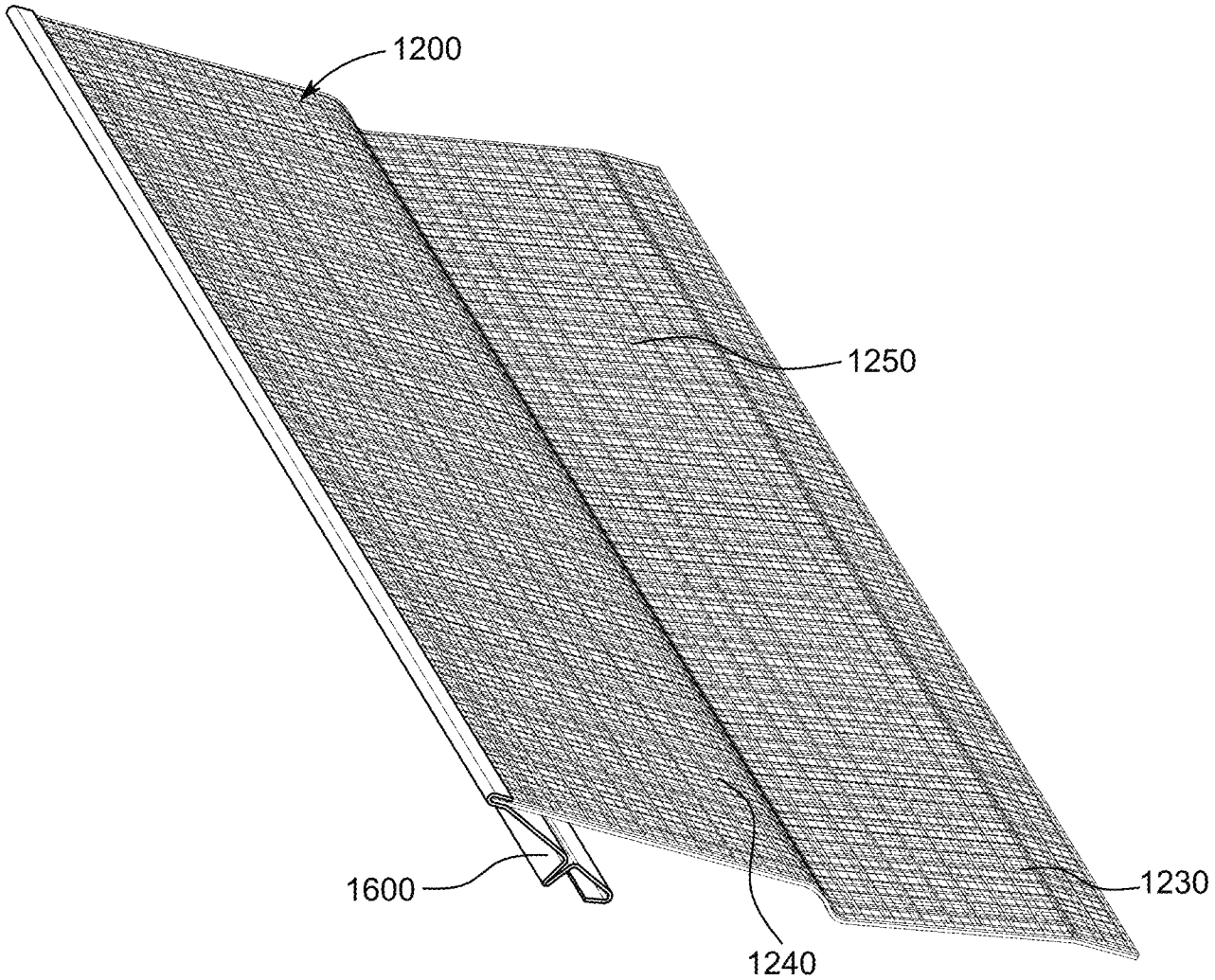
FIG. 37 schematically illustrates the screen assembly of FIG. 24 with an adaptor.

FIG. 37 illustrates the screen assembly 1200 of FIGS. 24-26 with an independent adaptor 1600. This adaptor 1600 is a separate component that can be secured to the front receiver of a gutter guard system to accommodate the arrangement of the screen assembly 1200. The adaptor 1600 includes a channel that engages with and secures the front edge 1260 of the screen assembly 1200. The adaptor 1600 can be secured to a screen assembly through any number of known attachment mechanisms, such as fasteners, adhesives, and the like. As with other descriptions of the screen assembly 1200, the adapter 1600 is arranged to secure the front end 1260 of the screen assembly 1200 in an elevated position relative to the gutter guard system such that the transition section 1250 and/or the front section 1230 manage the flow of rainwater across the screen assembly.

Figure 38:
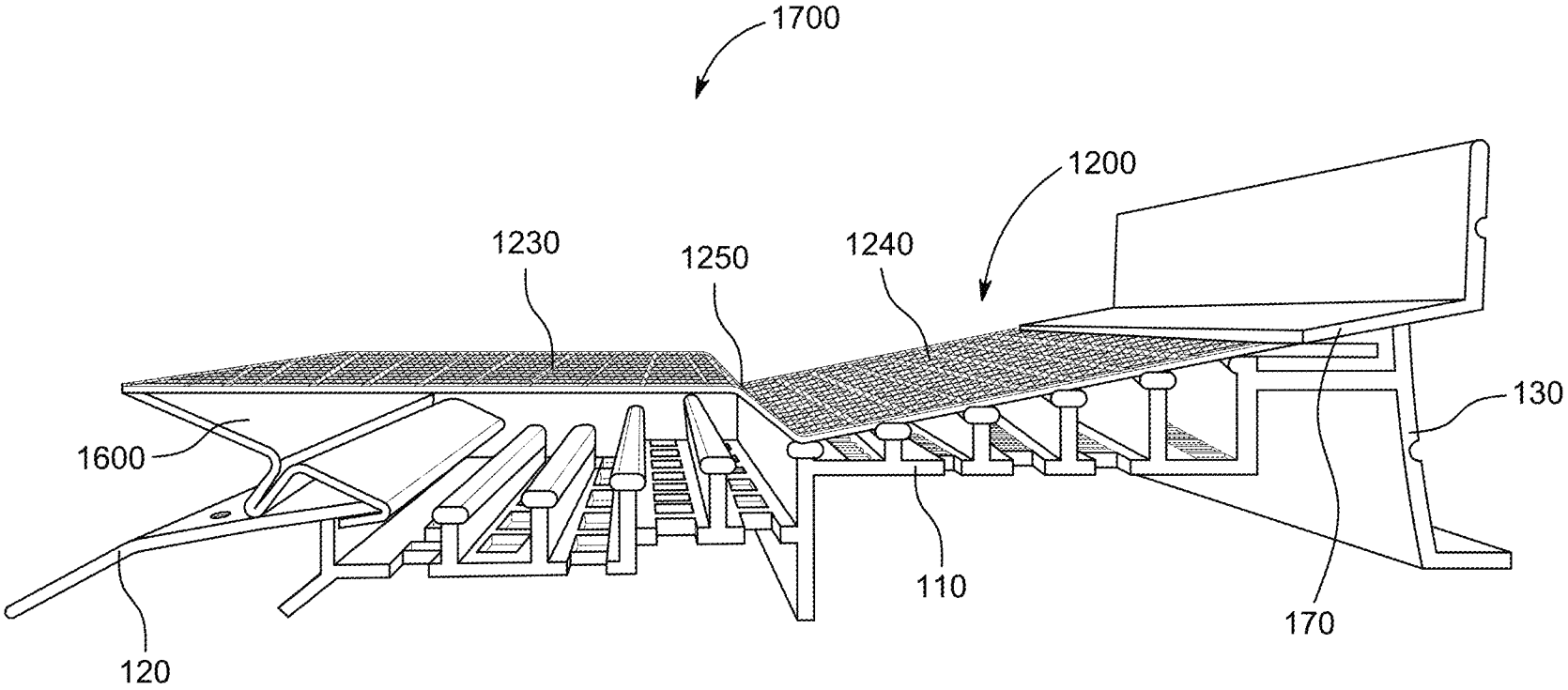
FIG. 38 schematically illustrates the screen assembly of FIG. 24 and adaptor of FIG. 37 assembled with the gutter guard system of FIG. 1.

FIG. 38 illustrates the adapter 1600 and screen assembly 1200 assembled with the gutter guard system of FIG. 1. The adaptor 1600 is secured on one end to the front receiver 120 and engages with and secures the screen assembly 1200 on its opposite end. As illustrated, even with the main body 110 positioned at a downwardly angle, the transition section 1250 is at an upwardly angle and the front section 1230 is generally flat. Such an arrangement will provide resistance and an obstacle to rainwater passing along the surface of the screen assembly 1200 and promote rainwater flowing downward into the rain gutter. In another embodiment, the features of the adaptor can be formed with the front receiver 120 so that the main body, rear receiver, and front receiver with an adaptor are formed as one integral component.

The foregoing description of examples has been presented for purposes of illustration and description. It is not intended to be exhaustive or limiting to the forms described. Numerous modifications are possible in light of the above teachings. Some of those modifications have been discussed, and others will be understood by those skilled in the art. The examples were chosen and described in order to best illustrate principles of various examples as are suited to particular uses contemplated. The scope is, of course, not limited to the examples set forth herein, but can be employed in any number of applications and equivalent devices by those of ordinary skill in the art.

We claim:

1. A screen assembly for use with a gutter guard system comprising:

a mesh screen comprising:

a first section;

a second section;

a waterflow obstacle section positioned between the first section and second section;

a first transition section;

a first tab;

a second transition section; and a second tab;

a grid comprising:

a first section that conforms in shape to the first section of the mesh screen;

a second section that conforms in shape to the second section of the mesh screen;

a waterflow obstacle section positioned between the first section and second section that conforms in shape to the waterflow obstacle section of the mesh screen;

a first transition section that conforms in shape to the first transition section of the mesh screen;

a first tab that conforms in shape to the first tab of the mesh screen;

a second transition section that conforms in shape to the second transition section of the mesh screen; and a second tab that conforms in shape to the waterflow obstacle section of the mesh screen;

wherein the mesh screen and grid are secured together to form the screen assembly;

wherein, when the mesh screen and grid are secured together:

the first section of the mesh screen and first section of the grid are positioned adjacent to each other and form a first section of the screen assembly;

the second section of the mesh screen and second section of the grid are positioned adjacent to each other and form a second section of the screen assembly;

the waterflow obstacle section of the mesh screen and waterflow obstacle section of the grid are positioned adjacent to each other and form a waterflow obstacle section of the screen assembly;

the first transition section of the mesh screen and first transition section of the grid are positioned adjacent to each other and form a first transition section of the screen assembly;

the first tab of the mesh screen and the first tab of the grid are positioned adjacent to each other and form a first tab of the screen assembly;

the second transition section of the mesh screen and second transition section of the grid are positioned adjacent to each other and form a second transition section of the screen assembly; and the second tab of the mesh screen and the second tab of the grid are positioned adjacent to each other and form a second tab of the screen assembly; and wherein when the screen assembly is positioned in a gutter guard system, the waterflow obstacle section of the screen assembly slows the flow of water across the screen assembly.

2. The screen assembly of claim 1, wherein the mesh screen is fabricated from metal wire of approximately 0.0085 inch diameter.

3. The screen assembly of claim 2, wherein the metal wire of the mesh screen is 316L stainless steel.

4. The screen assembly of claim 2, wherein the metal wire of the mesh screen is arranged in a square weave such that there are approximately thirty wires in each linear inch of the mesh screen.

5. The screen assembly of claim 1, wherein the grid Is fabricated from metal wire of approximately 0.022 inch diameter.

6. The screen assembly of claim 5, wherein the metal wire of the grid is 316L stainless steel.

7. The screen assembly of claim 5, wherein the metal wire of the grid is arranged in a matrix such that there are four wires in each linear inch of the grid.

8. The screen assembly of claim 1, wherein the mesh screen and grid are secured together through a spot welding process.

9. The screen assembly of claim 1, wherein the mesh screen and grid are secured together through a process of overlaying portions of the mesh screen along one or more edges of the grid and crimping the portions of the mesh screen about the edges of the grid.

10. The screen assembly of claim 1, wherein the waterflow obstacle section of the screen assembly is generally semicircular in shape, rises above the remainder of the screen assembly, and extends along a longitudinal length of the screen assembly.

11. The screen assembly of claim 10, wherein the first section of the screen assembly is a rectangular, generally flat section that extends along the longitudinal length of the screen assembly.

12. The screen assembly of claim 11, wherein the second section of the screen assembly is a rectangular, generally flat section that extends along the longitudinal length of the screen assembly.

13. The screen assembly of claim 12, wherein the width of the first section of the screen assembly is less than the width than the second section of the screen assembly.

14. The screen assembly of claim 10, wherein the waterflow obstacle section of the screen assembly rises approximately 0.75 inches at its apex above the remainder of the screen assembly.

15. The screen assembly of claim 1, wherein the first transition section of the screen assembly extends downward from the first section of the screen assembly.

16. The screen assembly of claim 15, where the first tab extends from the first transition section of the screen assembly and is generally parallel to the first section of the screen assembly.

17. The screen assembly of claim 1, wherein the second transition section of the screen assembly extends downward from the second section of the screen assembly.

18. The screen assembly of claim 17, where the second tab extends from the second transition section of the screen assembly and is generally parallel to the second section of the screen assembly.

19. The screen assembly of claim 1, wherein the waterflow obstacle section of the screen assembly is a rectangular, generally flat section joining the first section of the screen assembly and the second section of the screen assembly, and extending along a longitudinal length of the screen assembly.

20. The screen assembly of claim 19, wherein the first section of the screen assembly is a rectangular, generally flat section that extends along the longitudinal length of the screen assembly.

21. The screen assembly of claim 20, wherein the second section of the screen assembly is a rectangular, generally flat section that extends along the longitudinal length of the screen assembly.

22. The screen assembly of claim 21, wherein the width of the first section of the screen assembly is less than the width than the second section of the screen assembly.

23. The screen assembly of claim 22, wherein the width of the waterflow obstacle section of the screen assembly is less than both the width of the first section of the screen assembly and the width of the second section of the screen assembly.

24. The screen assembly of claim 23, wherein the waterflow obstacle section of the screen assembly is:

arranged at a first angle to the first section of the screen assembly and arranged at a second angle to the second section of the screen assembly.

25. The screen assembly of claim 24, wherein the waterflow obstacle section of the screen assembly is arranged as a generally inclined plane from the second section of the screen assembly to the first section of the screen assembly.

26. The screen assembly of claim 25, wherein the first section of the screen assembly is not parallel to the second section of the screen assembly.

* * * * *